US007805869B1

(12) United States Patent
Pascarelli et al.

(10) Patent No.: US 7,805,869 B1
(45) Date of Patent: Oct. 5, 2010

(54) METHOD OF ADVERTISING IN A RESTROOM

(76) Inventors: Charles Pascarelli, 2 Beechwood Ter., Kinnelon, NJ (US) 07405; David Furman, 30 Brush Hill Rd., Kinnelon, NJ (US) 07405

( * ) Notice: Subject to any disclaimer, the term of this patent is extended or adjusted under 35 U.S.C. 154(b) by 280 days.

(21) Appl. No.: 11/821,750

(22) Filed: Jun. 25, 2007

(51) Int. Cl.
*G09F 1/08* (2006.01)

(52) U.S. Cl. ..... 40/539; 40/538; 40/606.03; 4/301; 4/310; 4/661

(58) Field of Classification Search ..... 40/539, 40/538; 4/314, 661, 301, 310
See application file for complete search history.

(56) References Cited

U.S. PATENT DOCUMENTS 2,335,609 A * 11/1943 Plowe ..... 40/539
3,566,414 A * 3/1971 Basner ..... 4/661
5,259,028 A * 11/1993 Westbrook ..... 379/455
5,435,018 A * 7/1995 Nishimoto ..... 4/306
5,561,930 A * 10/1996 Ashley et al. ..... 40/538
5,671,558 A * 9/1997 Lakin ..... 40/661
6,527,239 B1 * 3/2003 Smith ..... 248/311.2
6,668,392 B2 * 12/2003 Mason ..... 4/449
2006/0064910 A1 * 3/2006 Shankle ..... 40/594
2006/0143822 A1 * 7/2006 Kelley ..... 4/661
2006/0231717 A1 * 10/2006 Coren ..... 248/311.2

* cited by examiner

*Primary Examiner*—Lesley Morris
*Assistant Examiner*—Christopher E Veraa
(74) *Attorney, Agent, or Firm*—Day Pitney LLP

(57) ABSTRACT

A method for advertising in a restroom is shown and described. The method includes the use of a three-dimensional advertisement article which may attach to a wall above a urinal and at least partly cover the urinal. The advertisement article may resemble a container, perhaps a bottle or can, for a product, which may be beer or a soft drink, being advertised.

19 Claims, 24 Drawing Sheets

METHOD OF ADVERTISING IN A RESTROOM

BACKGROUND OF THE INVENTION

1. Field of the Invention

The present invention is a method of advertising. More specifically, the present invention is a method for advertising in restrooms.

2. Description of the Prior Art

Numerous approaches have been taken in the prior art to advertise in restrooms. For example, U.S. Pat. No. Des. 370,938 shows a urinal shield of the variety used to hold a deodorizing and disinfectant cake over a drain in a urinal. The urinal shield disclosed in this patent includes an upstanding plaque on which an advertisement may be displayed.

U.S. Pat. No. 5,671,558 shows an advertisement display device which is removably secured to a toilet flush valve cap. The device includes a clear plastic valve cap cover which receives advertisements therein and is then placed over the valve cap. The device may be secured onto the valve cap by means of one or more set screws, and is held in position by means of the toilet water inlet pipe.

U.S. Pat. No. 5,867,848 discloses a thermochromic urinal display apparatus and method for displaying a message when activated by a warm urine stream and terminating the display when the apparatus is rinsed with cool rinse water. A urinal display screen is disclosed with advertisement, slogans or public service message either painted, printed, screened or incorporated onto the urinal display screen using thermochromic paint, ink, film or decal. The urinal display screen is placed so that the thermochromic display is above the water line in the urinal reservoir. A warm urine stream activates the thermochromic paint to induce opaqueness or clarity to reveal advertising slogans or public service messages to the user. Once flushed, the cool water from the urinal rinse deactivates the thermochromic paint so that it returns to its original state, thereby becoming opaque to conceal an underlying message from the next user. Alternatively, the message can be printed in thermochromic paint in a quiescent transparent state to become activated and visible in its active opaque state.

U.S. Pat. Nos. 6,527,239 and 6,899,309 show a beverage container support for supporting a beverage upon a component of a flush valve for use in public restroom facilities. The support includes a support surface upon which a beverage container could be placed as well as a depending skirt that can be used as a display surface for advertisements.

U.S. Pat. No. 7,096,521 shows a beverage holder with advertising display providing a slot at the top of the display for placement of an advertisement card, the beverage holder being designed to be attached to a flush valve housing in a commercial sanitary fixture such as a urinal or toilet without modification to the flush valve. The beverage holder has a base with a threaded opening for a long threaded shaft to hold a clear plastic display mounted on top of the shaft as a changeable eye-level advertisement and a plurality of depending legs with end teeth that engage the flush valve housing of the sanitary fixture.

Finally, U.S. Patent Application Publication No. US2002/0162934 A1 discloses a urinal coaster affixed to an upper portion of a plumbing fixture of a urinal. The coaster includes a planar section affixed to a top of the plumbing fixture by an elastomeric attachment section surrounding the upper portion of the plumbing fixture. A beverage container may be positioned on top of the planar section.

The present invention provides a more visually striking method of advertising than those existing in the prior art for restrooms. As will be made apparent below to the reader, the inventive method can make a more lasting impression and have a greater impact upon a viewer than those of earlier methods.

SUMMARY OF THE INVENTION

Accordingly, the present invention is a method of advertising in a restroom which includes the step of providing a urinal. The urinal is typically mounted on a wall, and has a top, a left side, a right side, a bottom, and an inner surface bounded by the top, left side, right side and bottom. The method further requires the step of providing a three-dimensional advertisement article, which may be bottle-shaped, can-shaped or of some other shape related to or suggestive of a product or service to be advertised. The advertisement article is adapted for attachment to the wall where the urinal is mounted and is adapted to cover at least the top of the urinal.

Advertisement graphics, such as those appearing on bottles or cans in which beverages are sold, are then placed on the advertisements and, finally, the advertisement article is attached to the wall to cover at least the top of the urinal.

In alternate embodiments of the invention, the advertisement article covers only the plumbing connection above the urinal or a side of the urinal.

In yet another embodiment of the invention, the method of advertising in a restroom includes the step of providing a sink, the sink being mounted on a wall and having a top surface. An advertisement article is then provided, the advertisement article being adapted for attachment to the wall above the top surface of the sink. Advertisement graphics are then placed on the advertisement article and, finally, the advertisement article is attached to the wall above the top surface of the sink.

The present invention will now be described in more completed detail with frequent reference being made to the figures identified below.

DETAILED DESCRIPTION OF THE PREFERRED EMBODIMENTS

Figure 1:
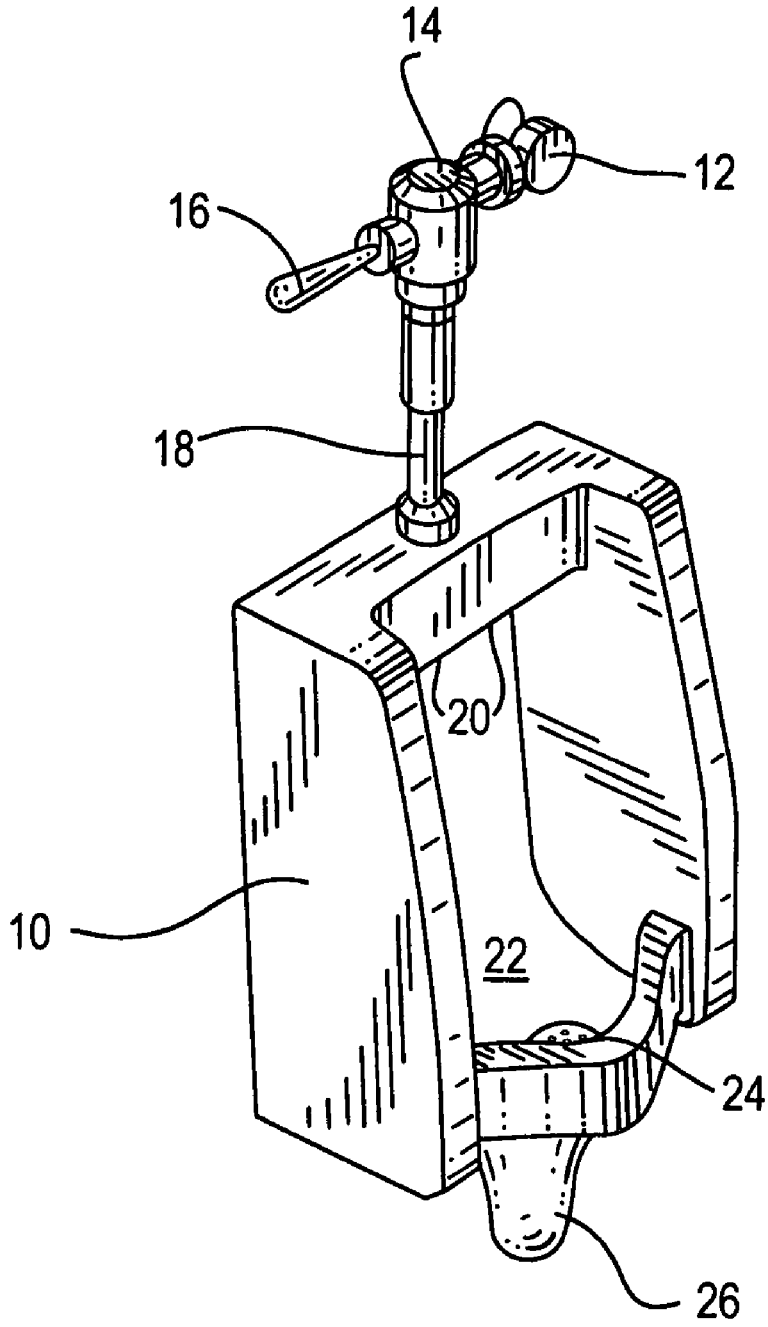
FIG. 1 is a perspective view of a typical urinal.

Turning now to these figures in detail, FIG. 1 is a perspective view of a typical urinal commonly found in men's restrooms in public and commercial establishments, such as, but, of course, not limited to, transportation facilities, stadiums, arenas, restaurants, public parks and so forth. The urinal 10 itself is commonly of a glazed ceramic, and is typically white, although it may be formed or molded from other water-impervious materials and may be of any color. The urinal 10 may be of a generally rectangular shape, as shown, although those of other shapes are manufactured and are available. The present invention is not restricted to urinals of any particular shape, and may be practiced with any of them.

The urinal 10 is mounted on a wall or other vertical support, and, regardless of shape, is connected to a water supply which passes through the wall or other vertical support in a pipe or other conduit. A first valve 12 regulates the flow rate of the water supplied to the urinal 10, while a second, or flush, valve 14, operable by handle 16, allows water to flow for a typically short amount of time, perhaps fifteen seconds, after a person using the urinal 10 pulls the handle 16. Water, delivered through pipe 18, is dispensed through holes 20 at the top of the inner surface 22, and flows downward along the inner surface 22 to a reservoir 24 at the bottom. Drain 26, generally including some form of P-trap, connects the urinal 10 to a waste pipe.

Figure 2:
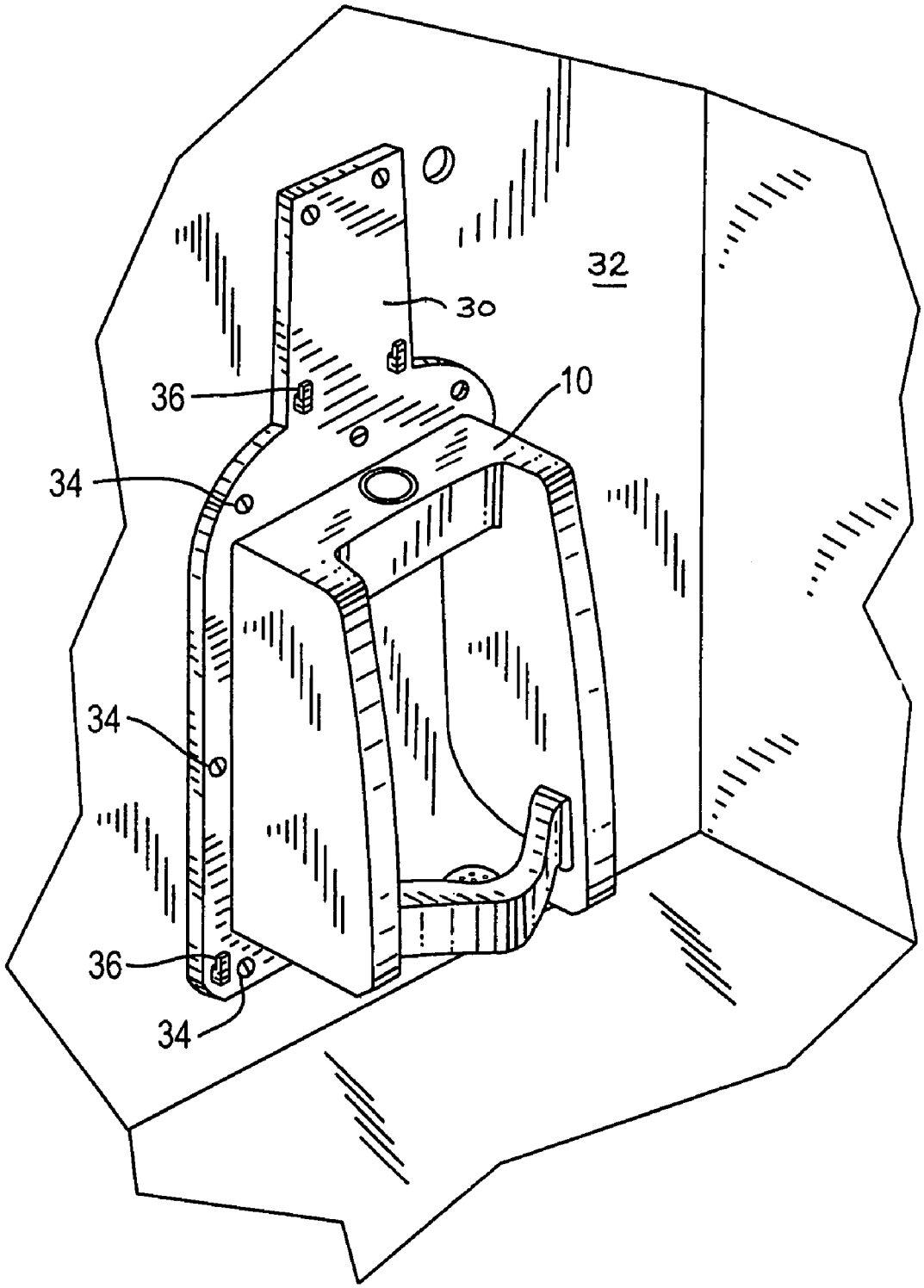
FIG. 2 is a perspective view of a wall adapter fixture mounted around a urinal.

Turning now to FIG. 2, in a first embodiment of the present invention, a wall adapter fixture 30 is mounted on a wall 32 around urinal 10 before the plumbing connection, namely, first and second (flush) valves 12, 14 and pipe 18, is made. Wall adapter fixture 30 may be held in place with an adhesive or by screws 34, and has a plurality of hooks 36 for mounting advertising materials.

Figure 3:
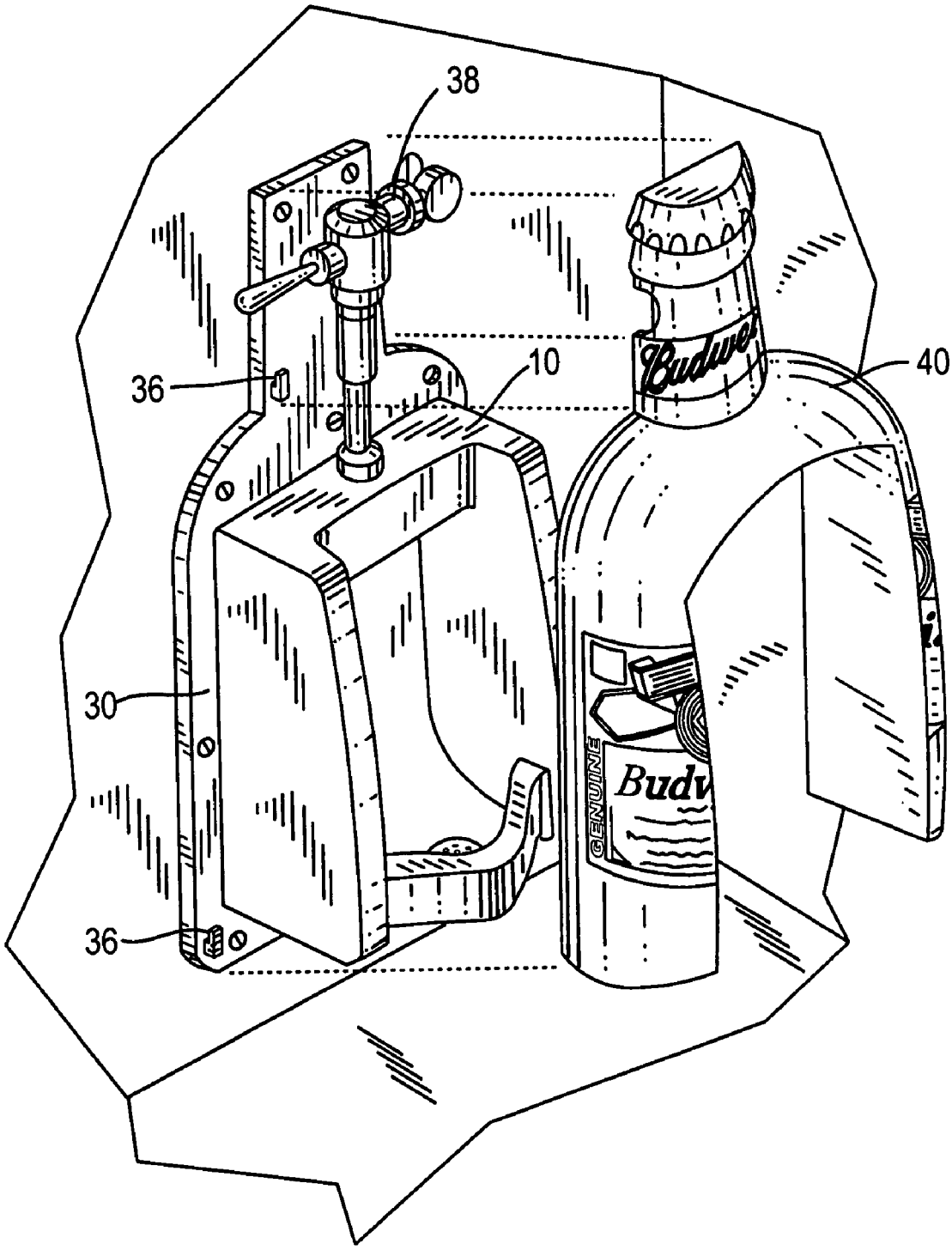
FIG. 3 is a perspective view showing the installation of a bottle-shaped advertisement article over a urinal.
Figure 4:
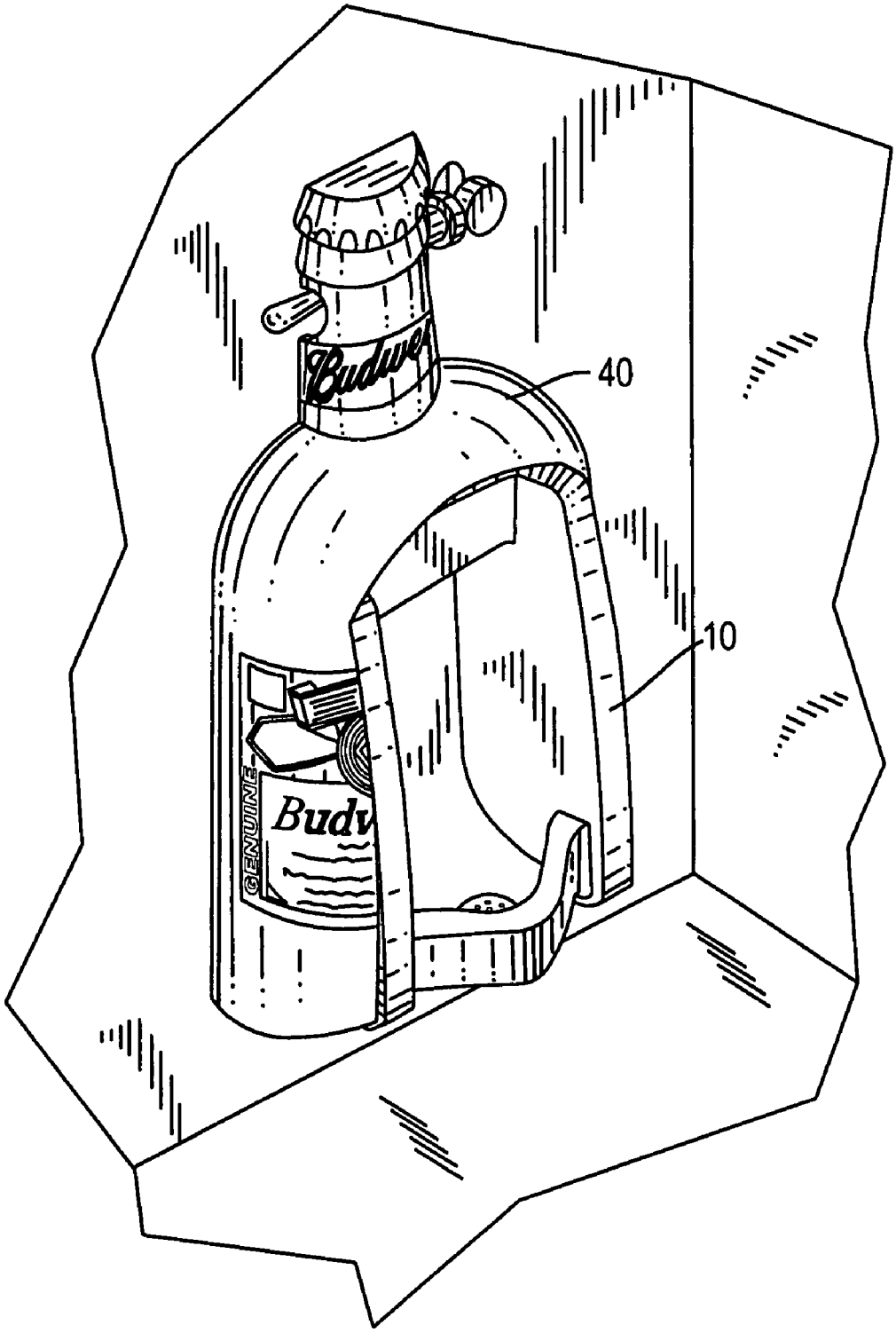
FIG. 4 is a perspective view showing the bottle-shaped advertisement article of FIG. 3 following installation over a urinal.

Turning now to FIG. 3, once the plumbing connection 38 to the urinal 10 is made, an advertisement article 40, shaped, in this instance, like a beer bottle, is disposed on the wall adapter fixture 30, substantially covering plumbing connections 38 and the top and sides of the urinal 10. Advertisement article 40 has slots, not shown in the figures, on rear surface thereof into which hooks 36 engage. The mounted advertisement article 40 is shown in FIG. 4.

Figure 5:
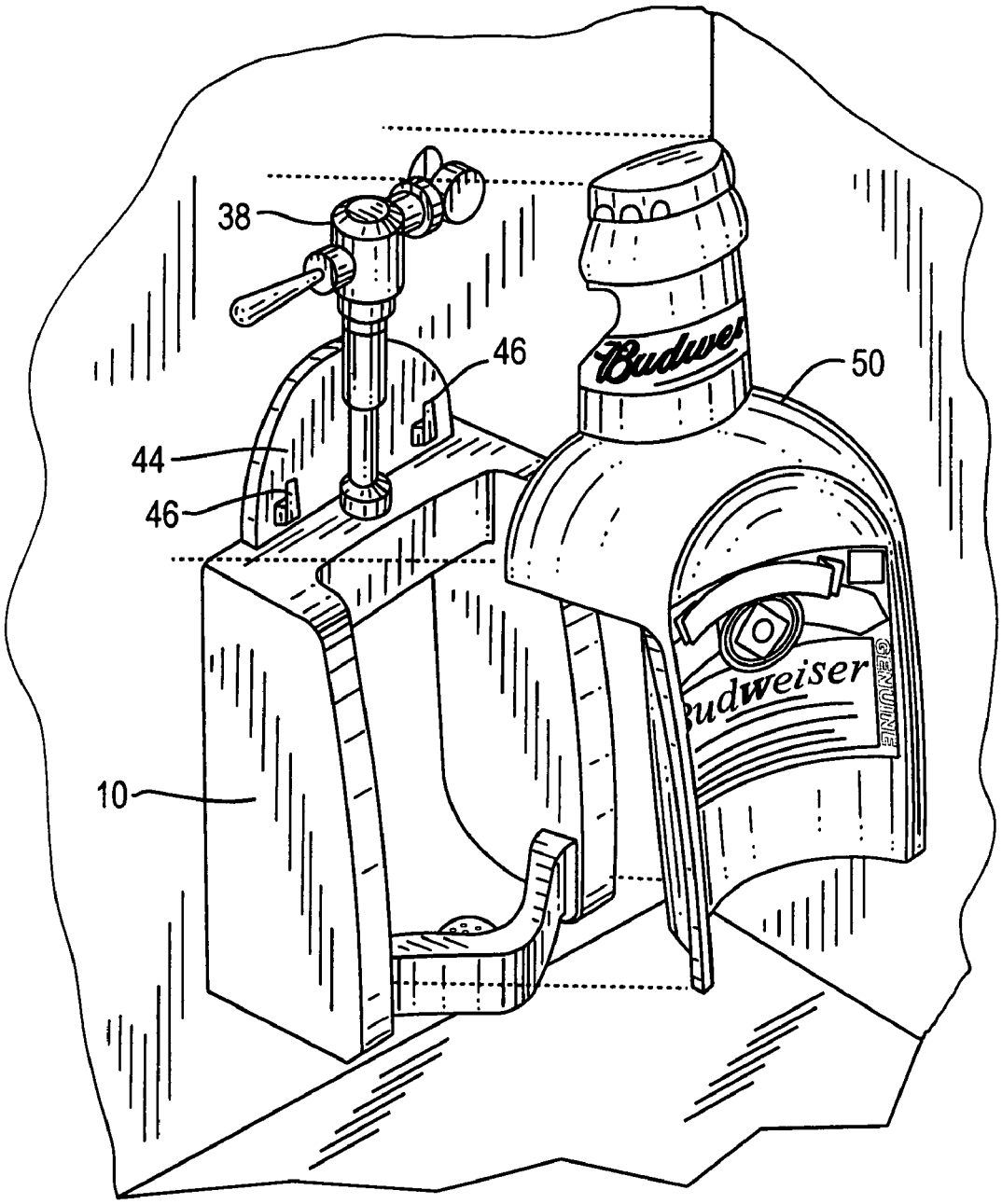
FIG. 5 is a perspective view showing the installation of an alternate embodiment of a bottle-shaped advertisement article over a urinal.
Figure 6:
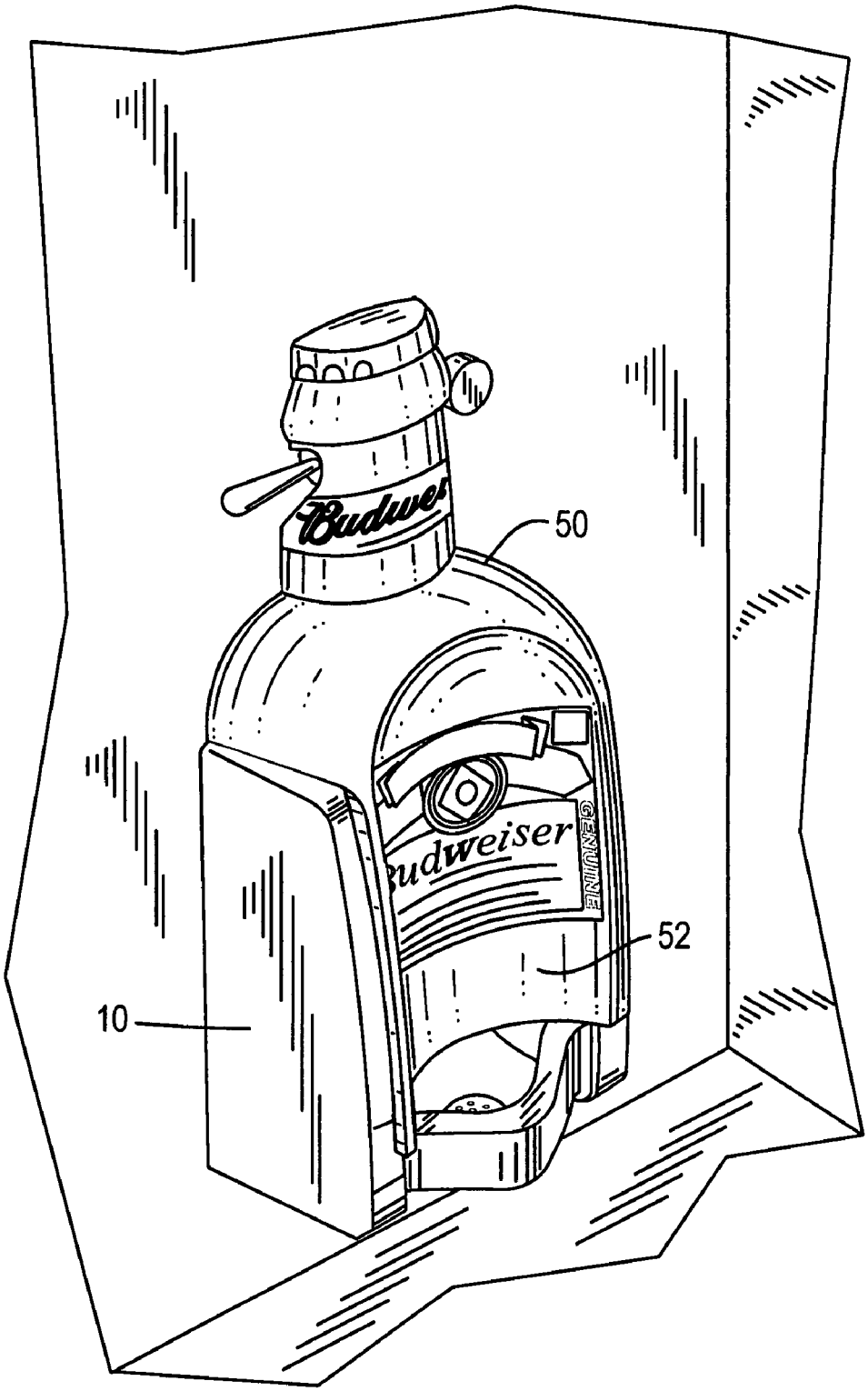
FIG. 6 is a perspective view showing the bottle-shaped advertisement article of FIG. 5 following installation over a urinal.

In a second embodiment, shown in FIG. 5, wall adapter fixture 44 may be installed behind a previously installed plumbing connection 38 to the urinal 10 and has a plurality of hooks 46 for mounting an advertisement 50. In this embodiment, advertisement article 50 substantially covers plumbing connection 38 and the top of the urinal 10. However, as shown in FIG. 6, when mounted, advertisement article 50 does not extend over the sides of urinal 10, but rather has a substantially concave central portion 52 which extends backward into the urinal 10 toward the inner surface 22 thereof.

Figure 7:
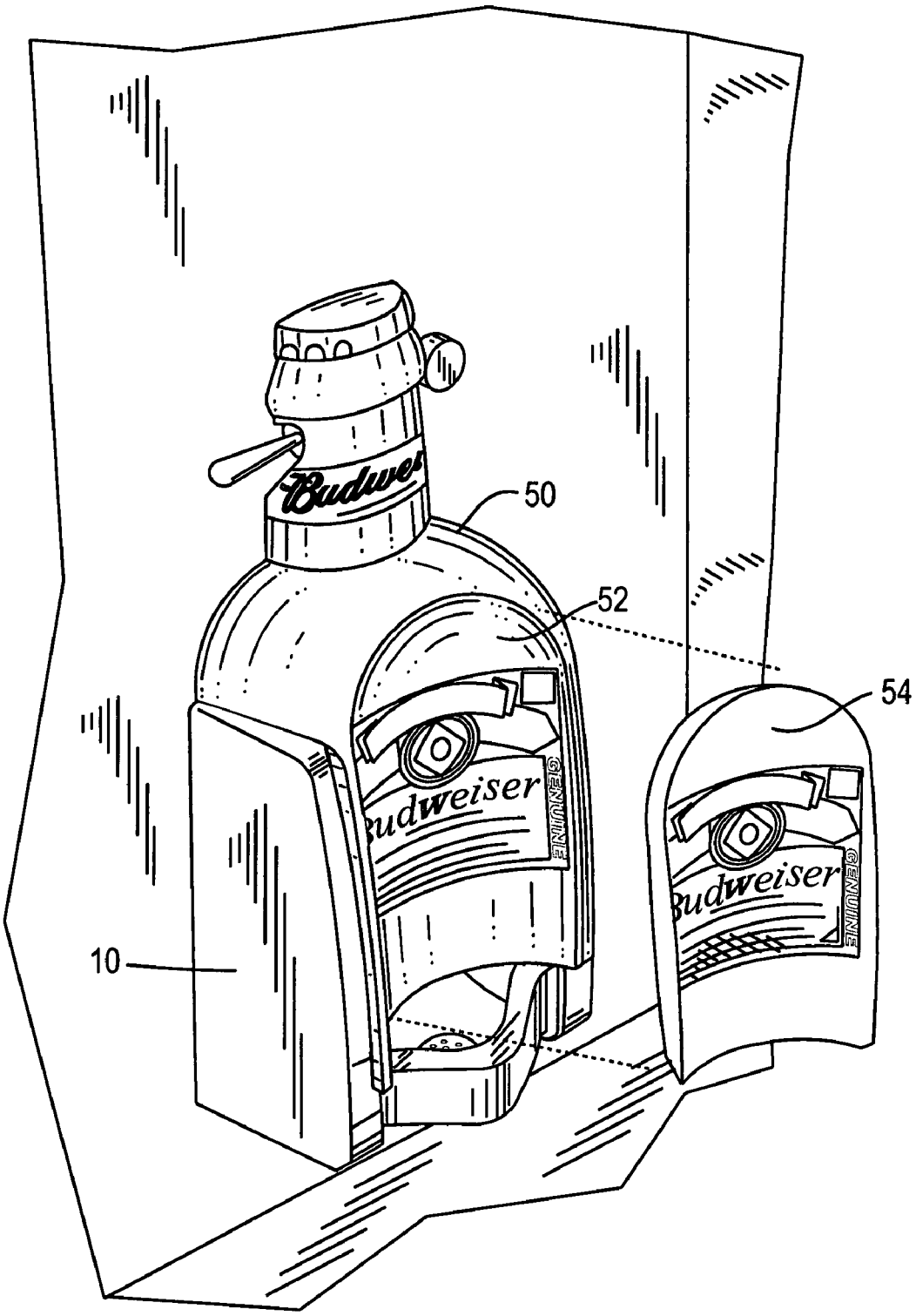
FIG. 7 is a perspective view of the installed bottle-shaped advertisement article of FIG. 6 showing the installation of a removable liner thereon.

It will become readily apparent to the reader that central portion 52 will not be rinsed by any water flowing downward along the inner surface 22 of the urinal 10 when the urinal 10 is flushed. Referring now to FIG. 7, the substantially concave central portion 52 may be provided with a removable liner 54 which may be taken out for cleaning or replacement.

Figure 8:
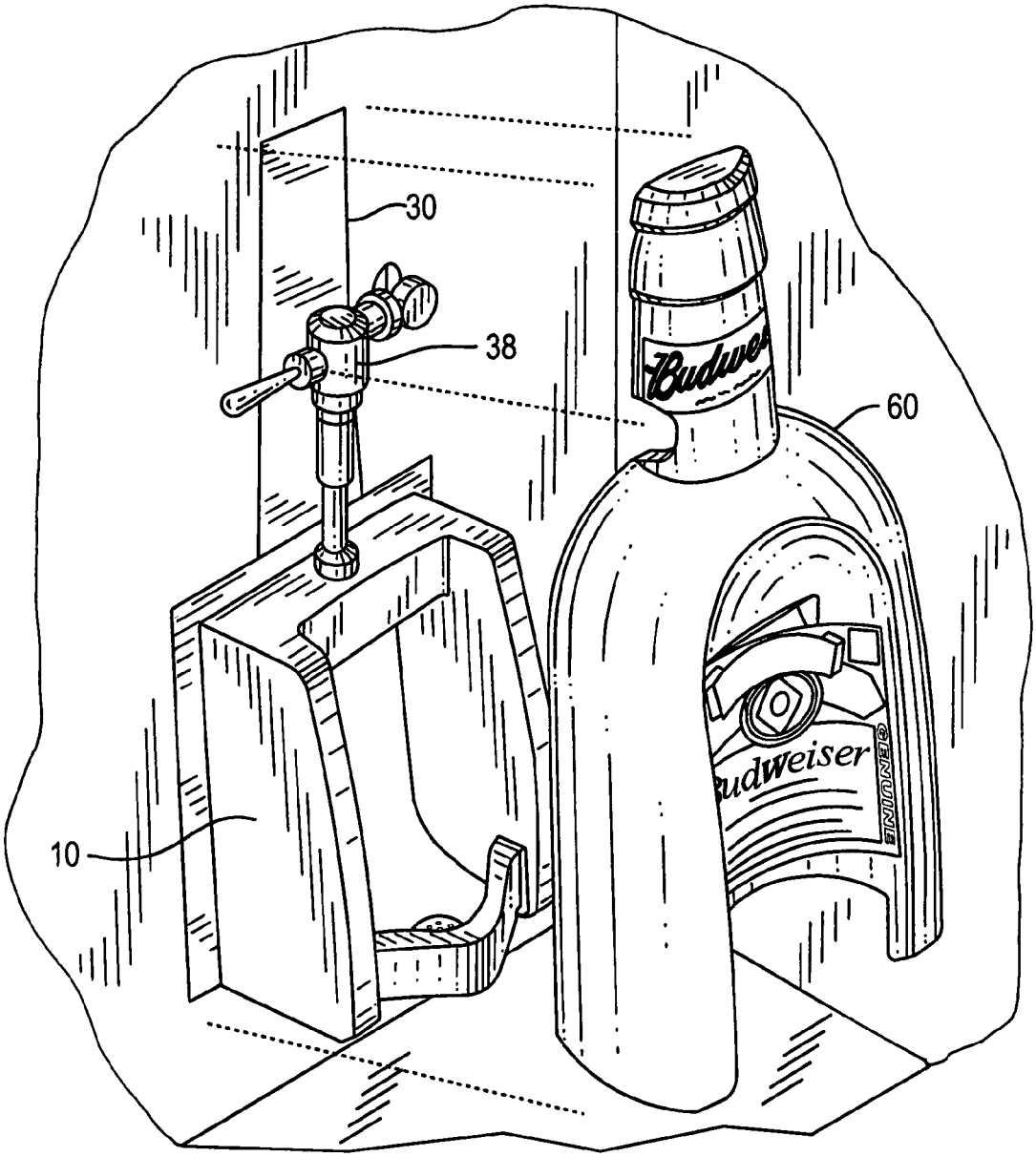
FIG. 8 is a perspective view showing the installation of yet another embodiment of a bottle-shaped advertisement article over a urinal.
Figure 9:
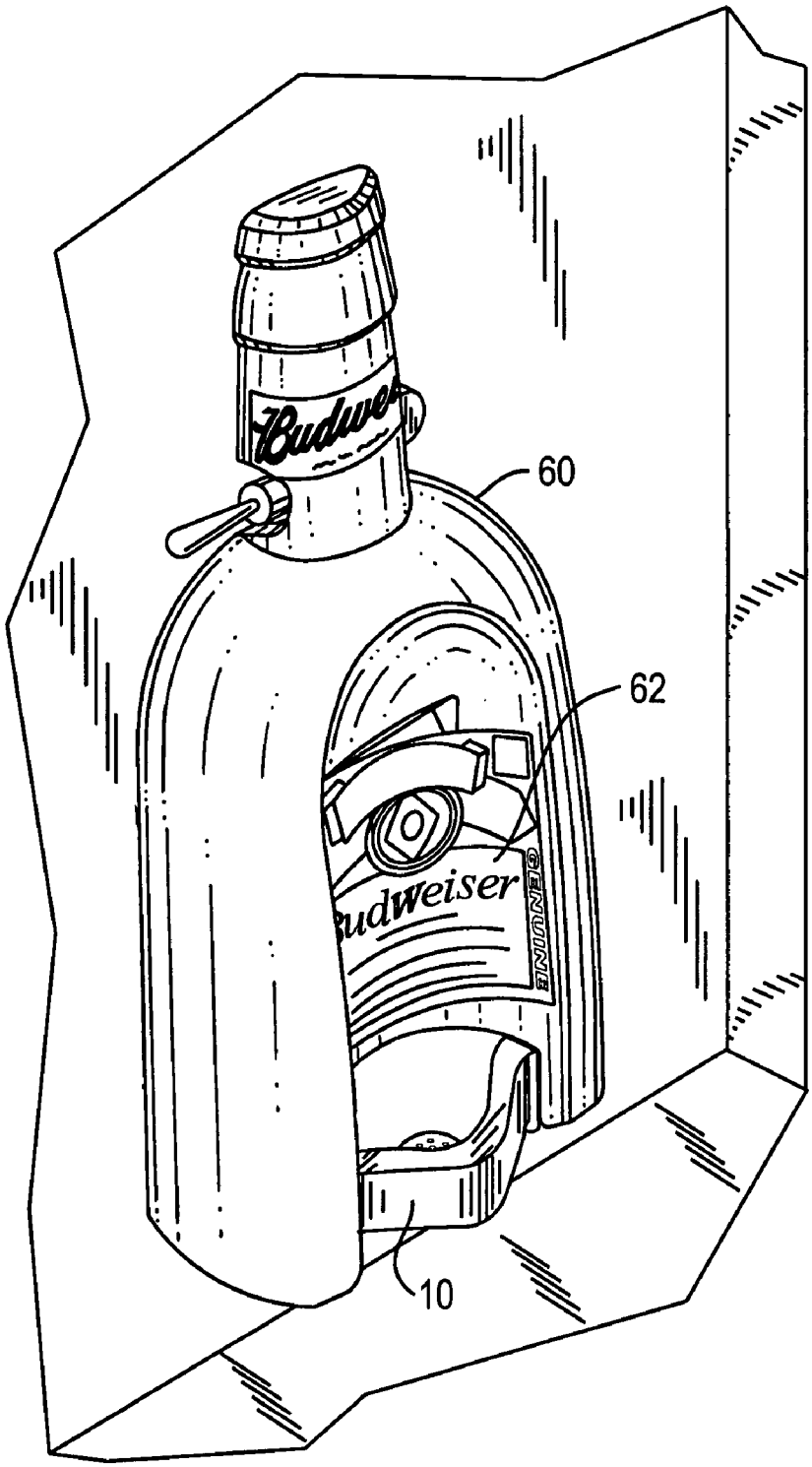
FIG. 9 is perspective view showing the bottle-shaped advertisement article of FIG. 8 following installation over a urinal.
Figure 10:
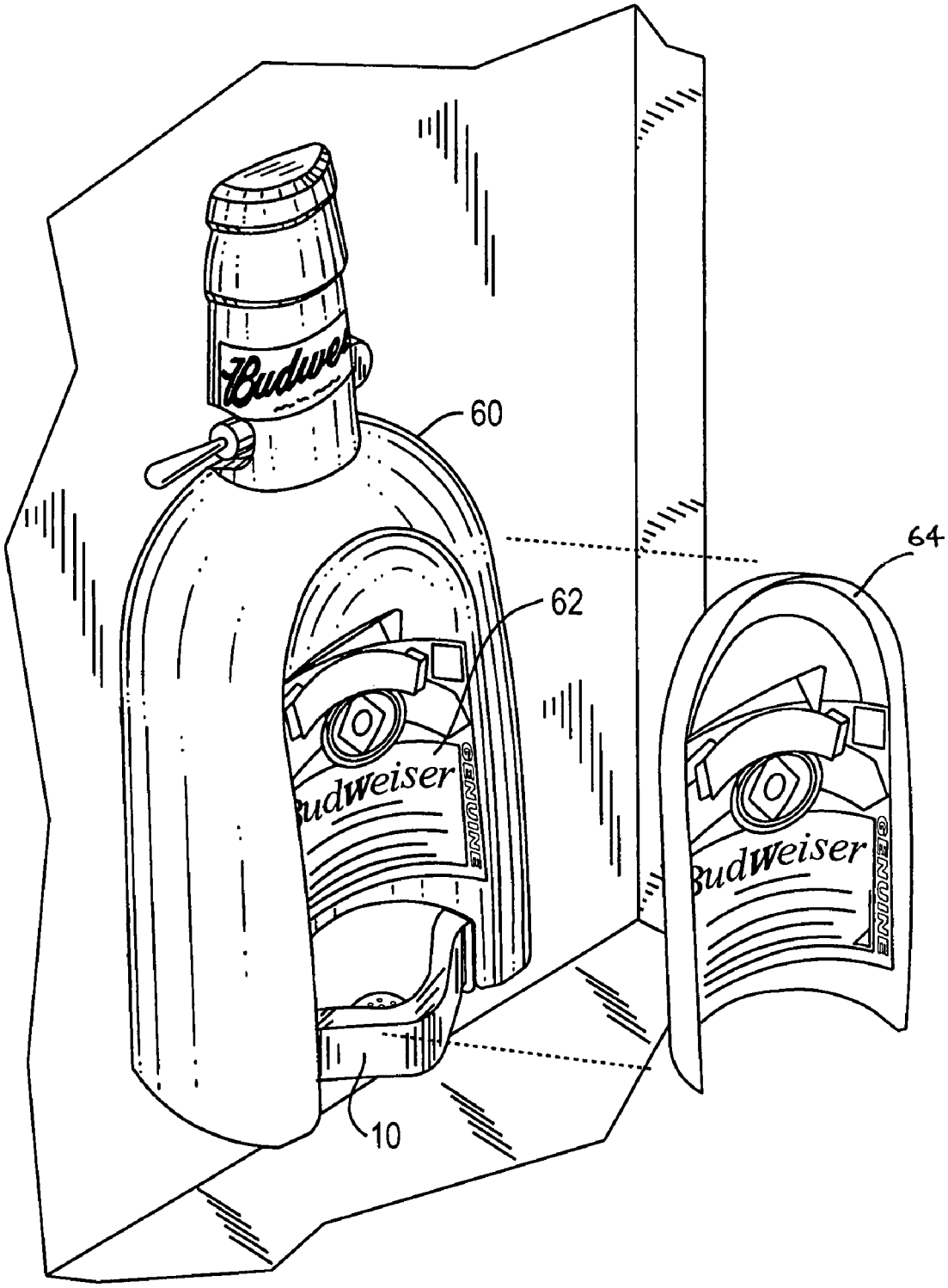
FIG. 10 is a perspective view of the installed bottle-shaped advertisement article of FIG. 9 showing the installation of a removable liner thereon.

In a third embodiment, shown in FIG. 8, advertisement article 60 is installed on wall adapter fixture 30, shown schematically in FIG. 8, but completely in FIG. 2. Advertisement article 60 in this third embodiment substantially covers plumbing connection 38 and the top and sides of the urinal 10, as shown in FIG. 9. Advertisement article 60 also has a substantially concave central portion 62, which, as shown in FIG. 10, may be provided with a removable liner 64 which may be taken out for cleaning or replacement, as was the case in FIG. 7.

Figure 11:
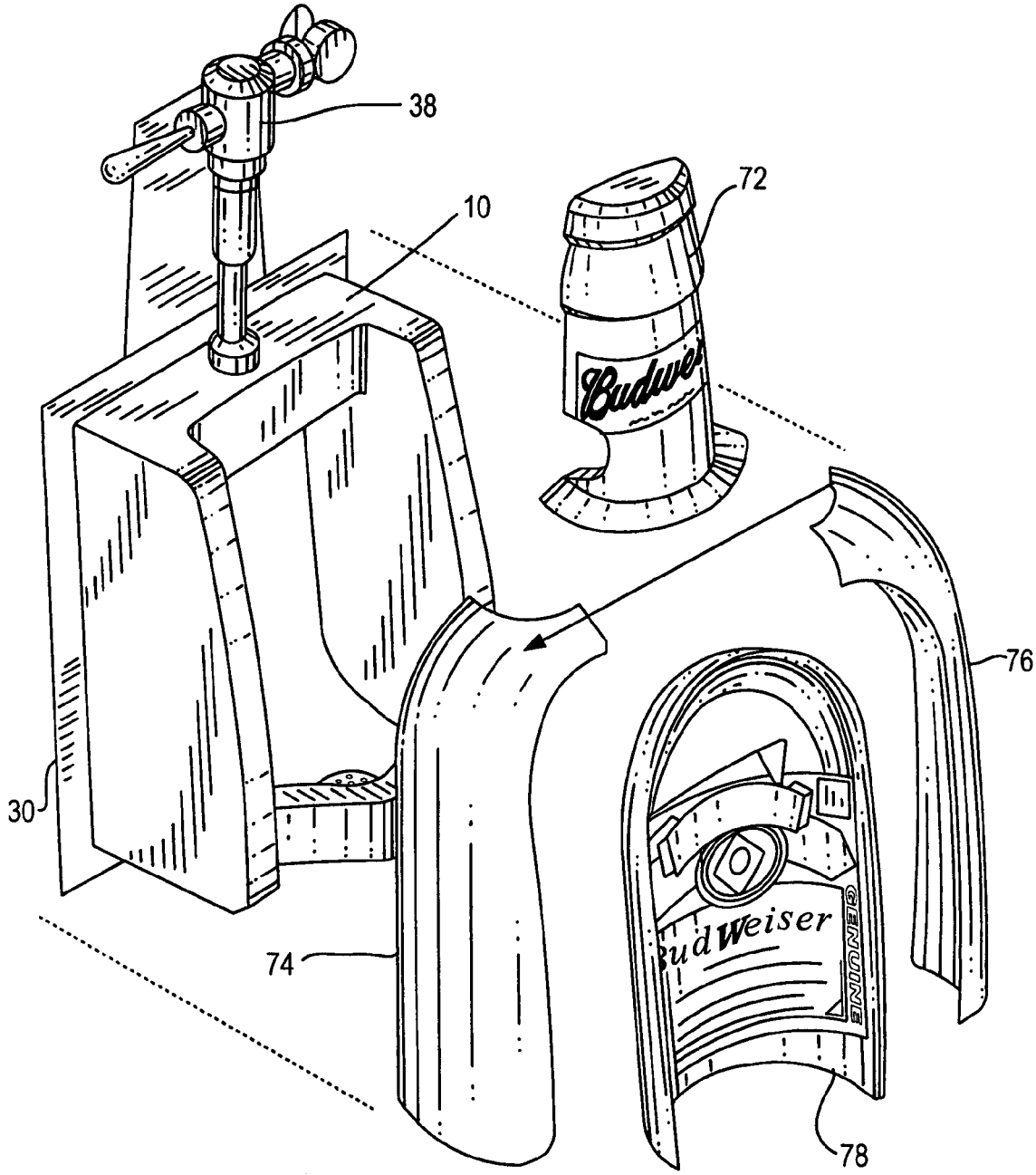
FIG. 11 is a perspective view showing the installation of a modular embodiment of a bottle-shaped advertisement article over a urinal.

In a fourth embodiment, shown in FIG. 11, a modular version of advertisement article 60 comprises a universal modular neck 72, a universal modular left side panel 74, a universal modular right side panel 76, and a removable inner liner 78. The latter could be adapted to fit into each specific brand of urinal.

Figure 12:
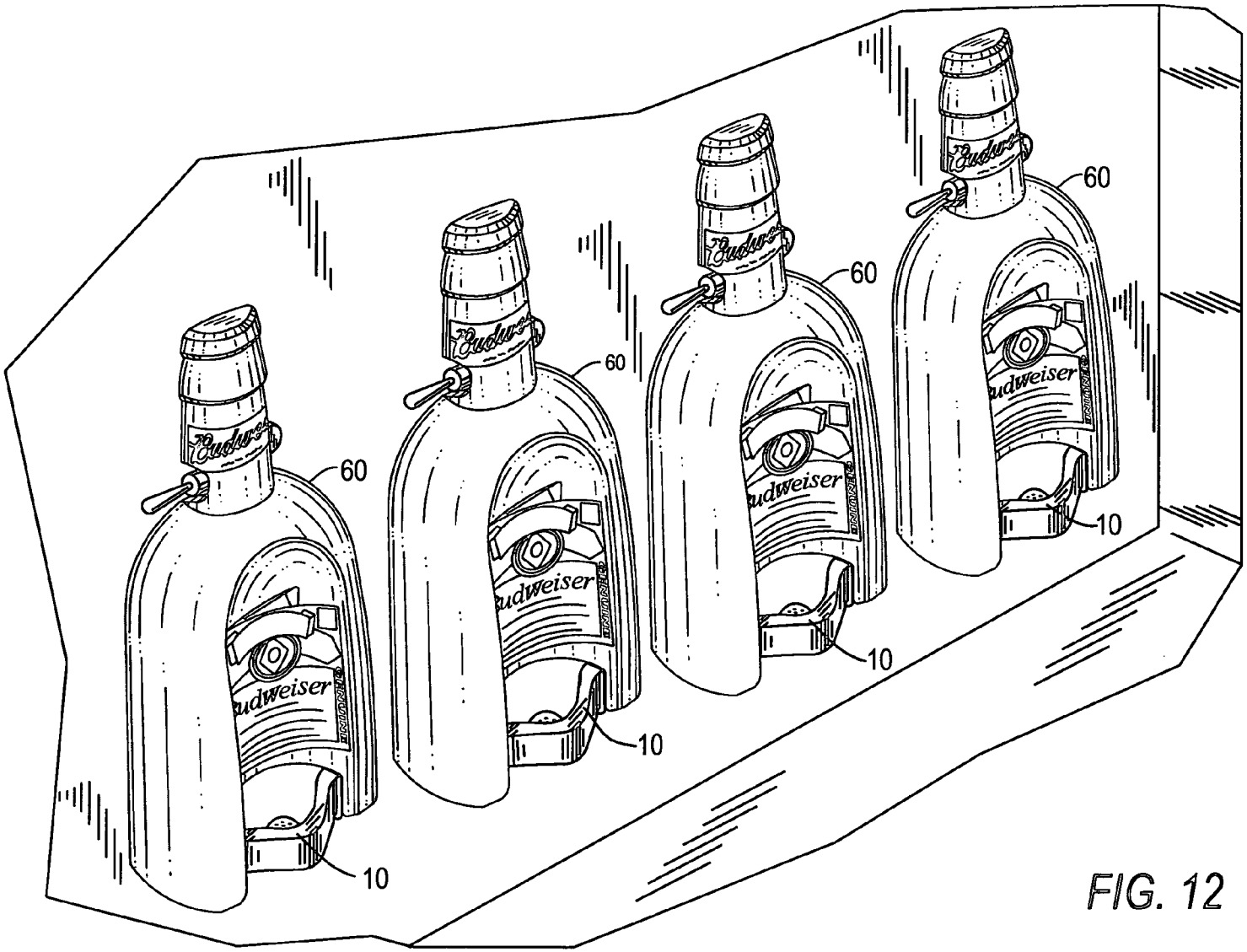
FIG. 12 is a perspective view of a row of urinals having bottle-shaped advertisement articles installed thereover.

FIG. 12 is a perspective view of a row of urinals 10 on which advertisement articles 60 have been installed and shows the overall impression that would be made upon a viewer of the urinals 10 by the practice of the present invention.

Figure 13:
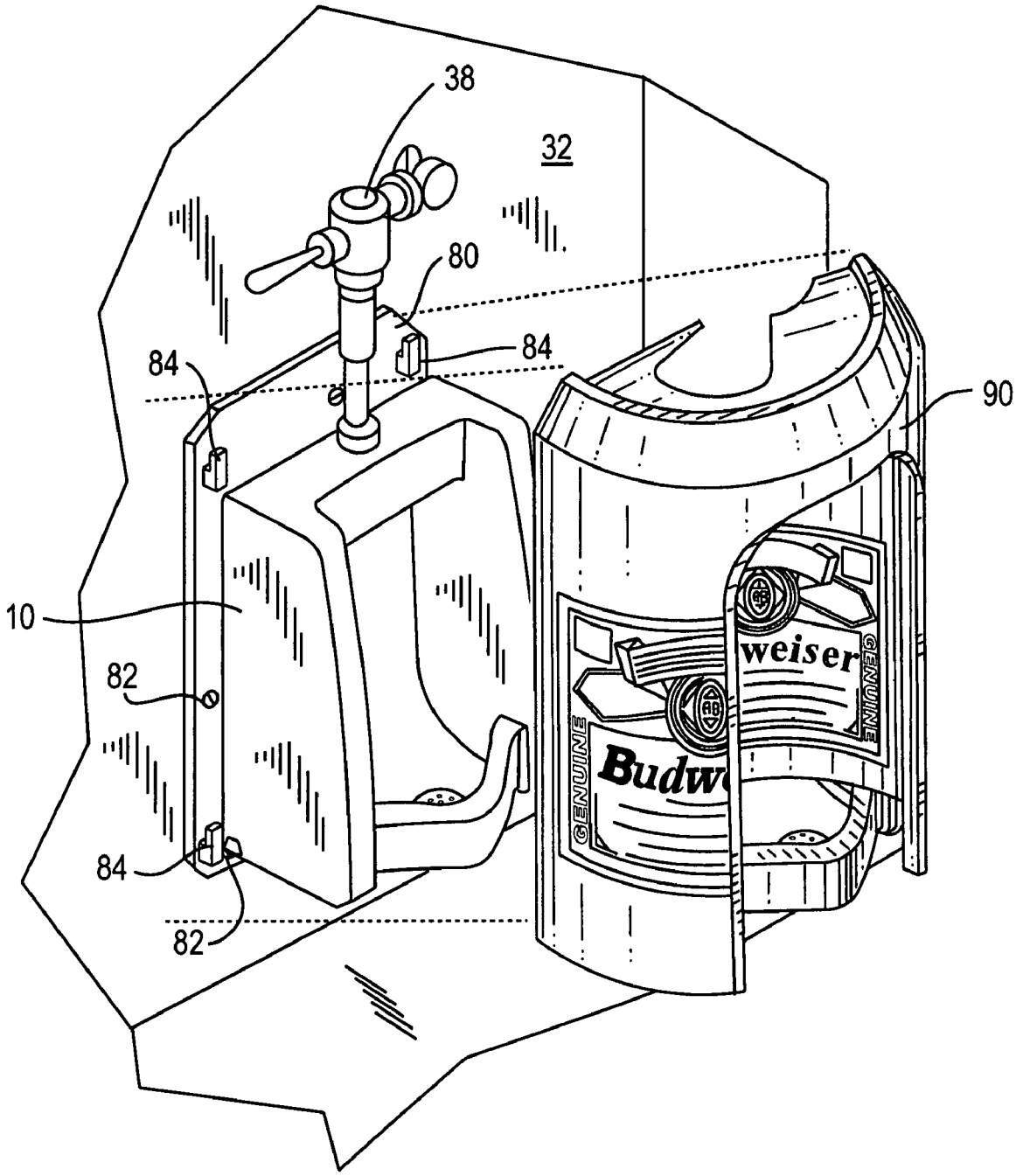
FIG. 13 is a perspective view showing the installation of a can-shaped advertisement article over a urinal.

Heretofore, the advertisement articles have been generally bottle-shaped. FIG. 13 shows a fifth embodiment of the present invention wherein the advertisement article is in the shape of a can.

Referring to FIG. 13, a wall adapter fixture 80 is mounted on a wall 32 around urinal 10 before the plumbing connection 38 is made. Wall adapter fixture 80 may be held in place with an adhesive or by screws 82, and has a plurality of hooks 84 for mounting advertising materials. An advertisement article 90, shaped like a beer can, is disposed on the wall adapter fixture 80, substantially covering the top and sides of the urinal 10. Advertisement article 90 has slots, not shown in the figures, on its rear surface into which hooks 84 engage. The mounted advertisement article 90 is shown in FIG. 14.

Figure 14:
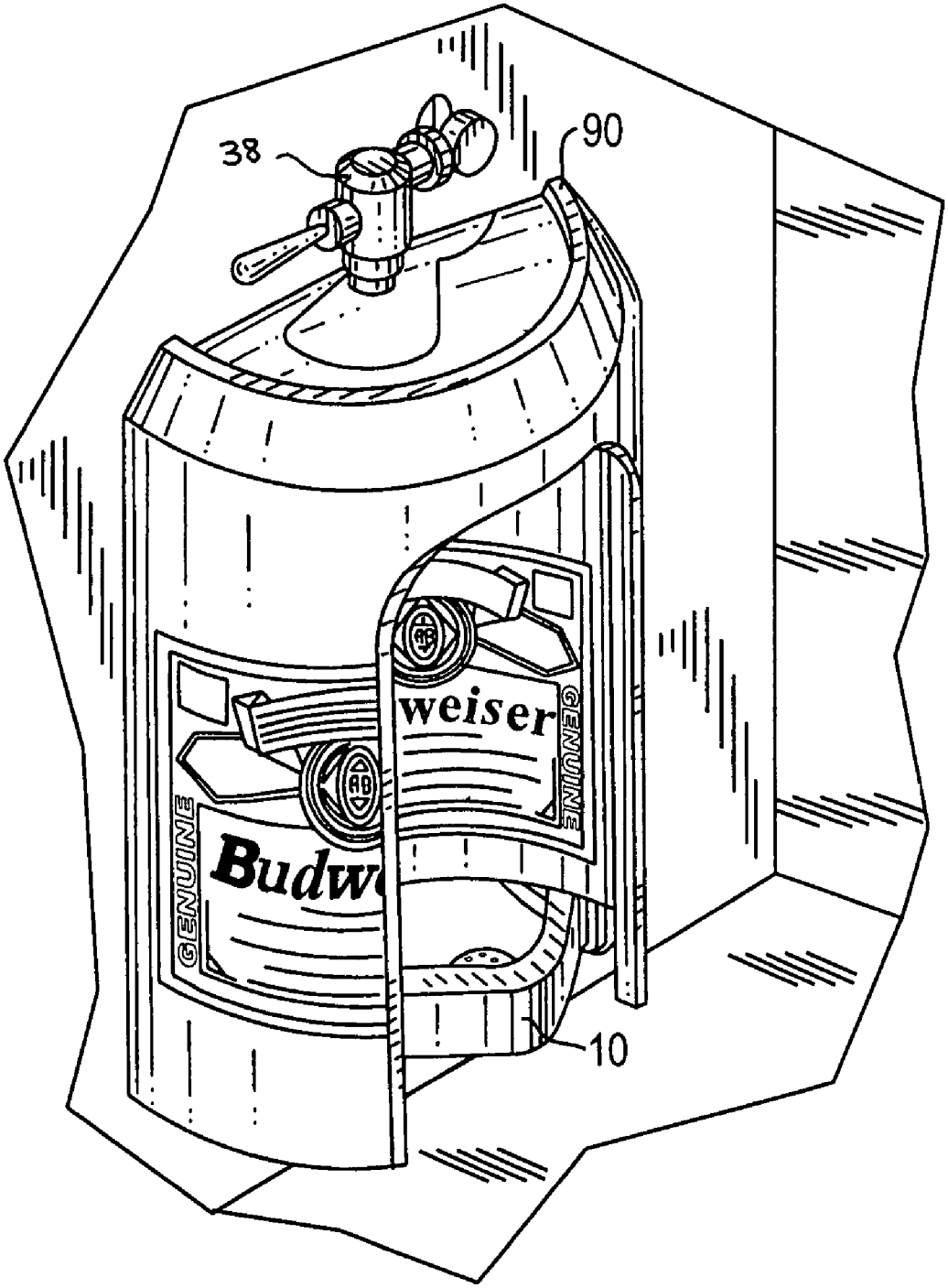
FIG. 14 is a perspective view showing the can-shaped advertisement article of FIG. 13 following installation over a urinal.
Figure 15:
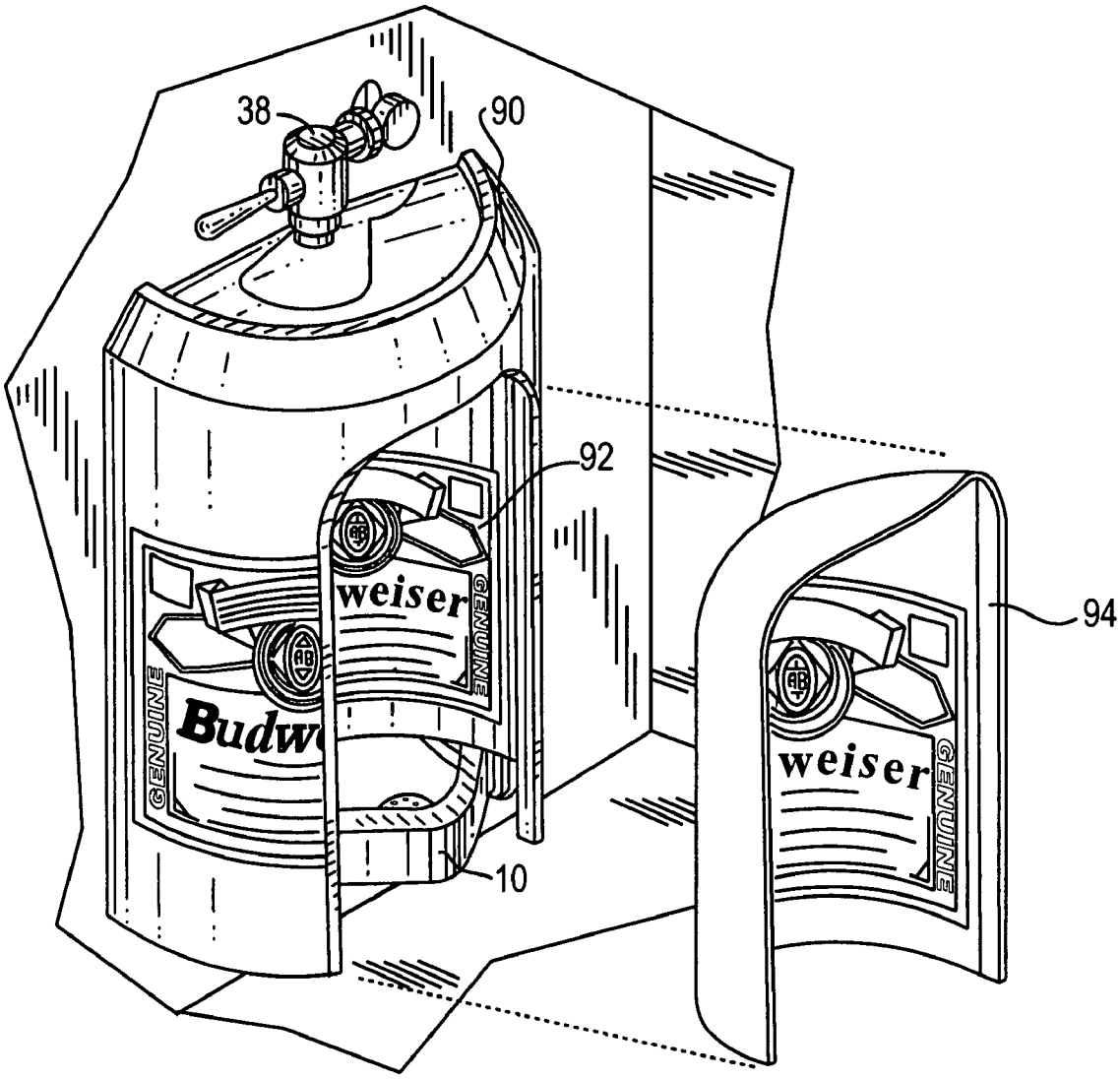
FIG. 15 is a perspective view of the installed can-shaped advertisement article of FIG. 14 showing the installation of a removable liner thereon.

It will be noted FIG. 14 that advertisement article 90 has a substantially concave central portion 92 which extends backward into the urinal 10 toward the inner surface 22 thereof. Referring now to FIG. 15, the substantially concave central portion 92 may be provided with a removable liner 94 which may be taken out for cleaning or replacement.

Figure 16:
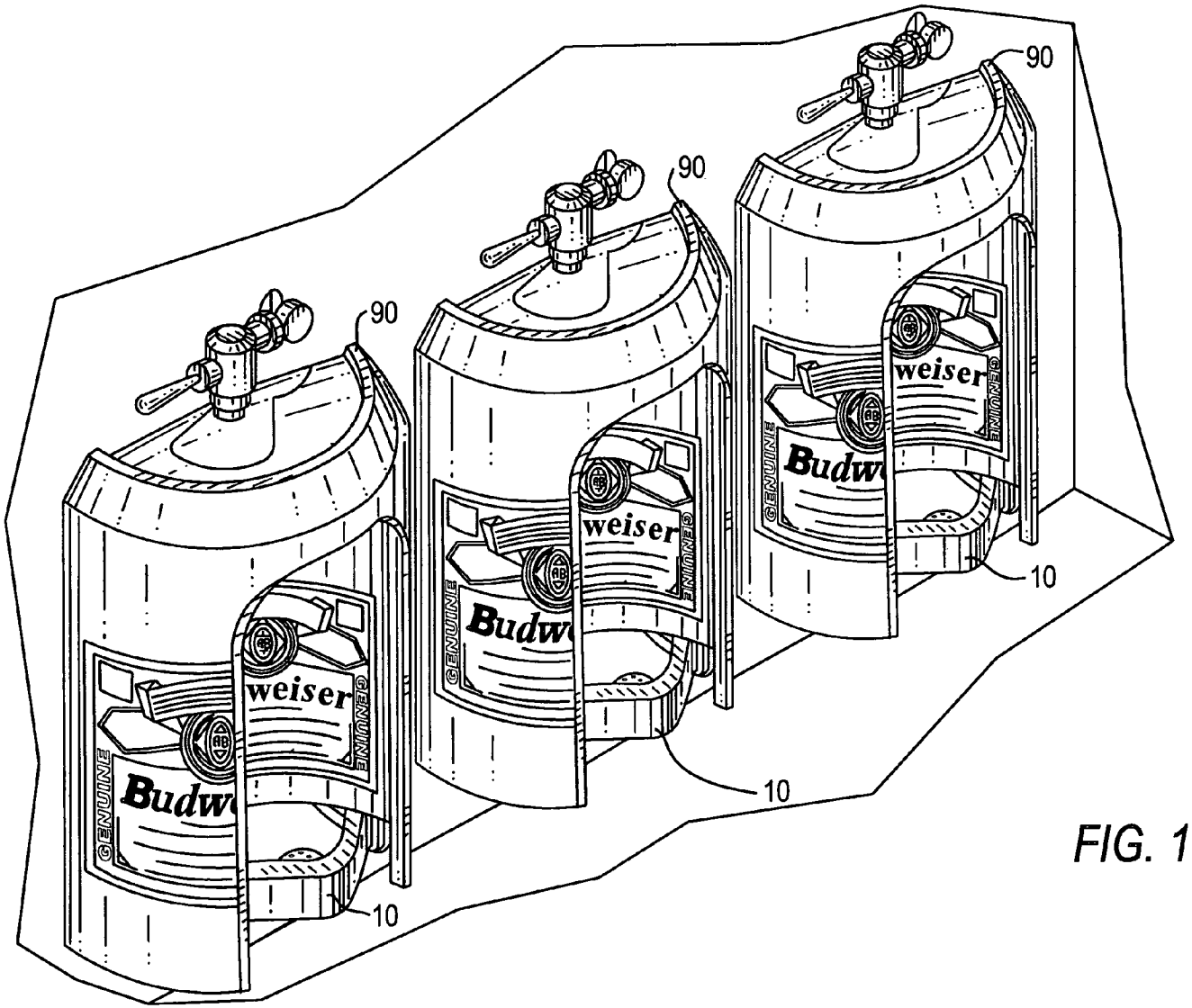
FIG. 16 is a perspective view of a row of urinals having can-shaped advertisement articles installed thereon.

FIG. 16 is a perspective view of a row of urinals 10 on which advertisement articles 90 have been installed and shows the overall impression that would be made upon a viewer of the urinals 10 by the practice of this embodiment of the present invention.

Figure 17:
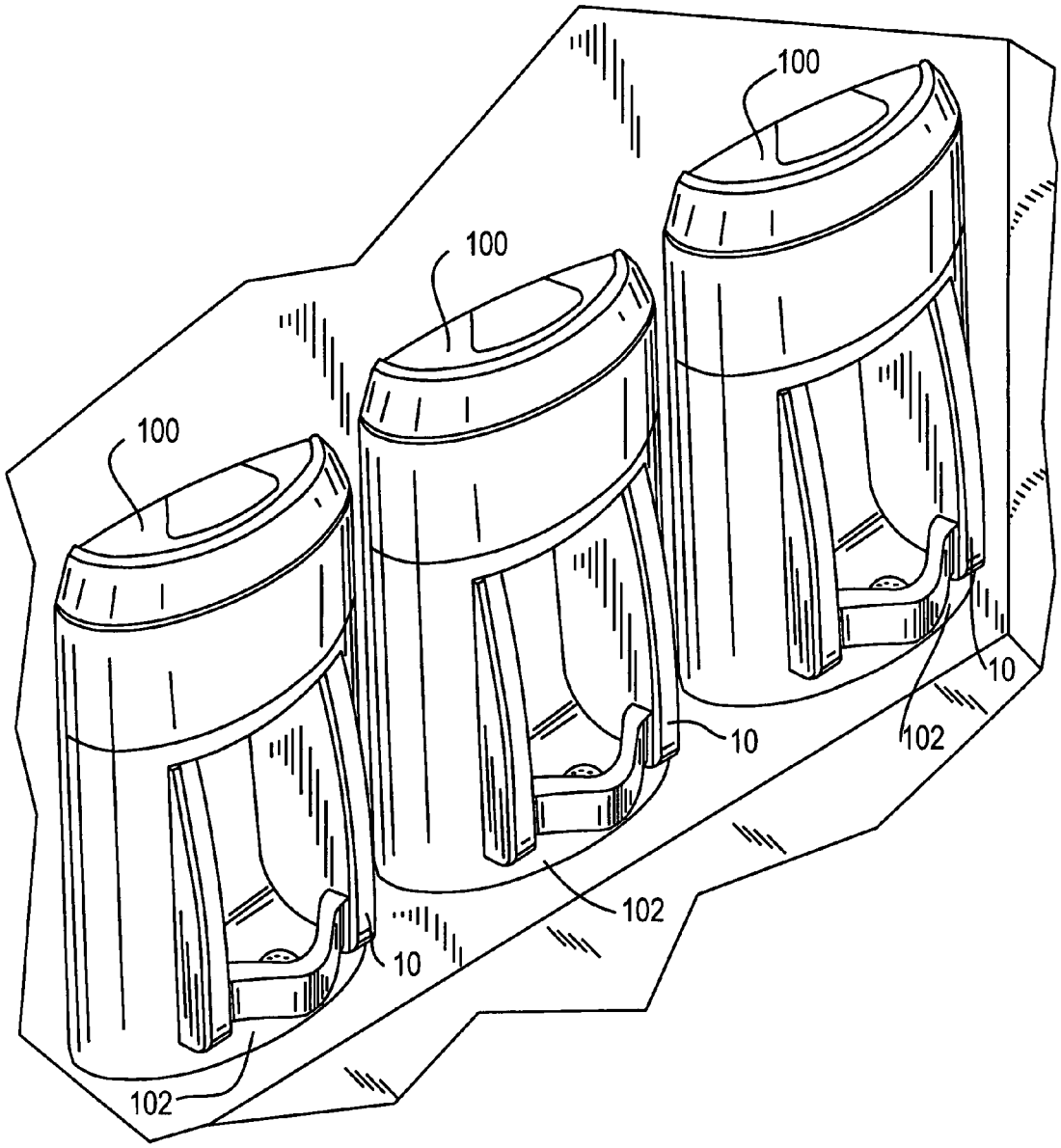
FIG. 17 is a perspective view of a row of urinals having can-shaped advertisement articles of an alternate embodiment installed thereon.

Referring now to FIG. 17, in an alternate embodiment from that shown in FIGS. 13 through 16, the advertisement articles 100 are flattened relative to advertisement article 90 so as not to protrude outwardly beyond the sides of urinals 10. Moreover, advertisement articles 100 have a bottom portion 102 and, accordingly, completely frame the urinals 100.

Figure 18B:
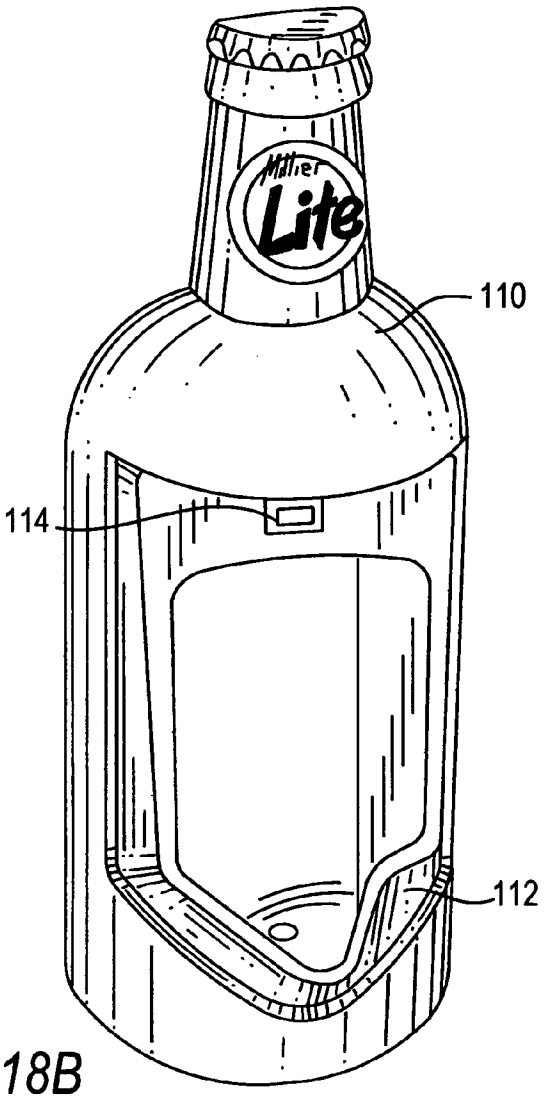
FIG. 18B is a perspective view showing the bottle-shaped advertisement article of FIG. 18A following installation over a urinal.
Figure 18A:
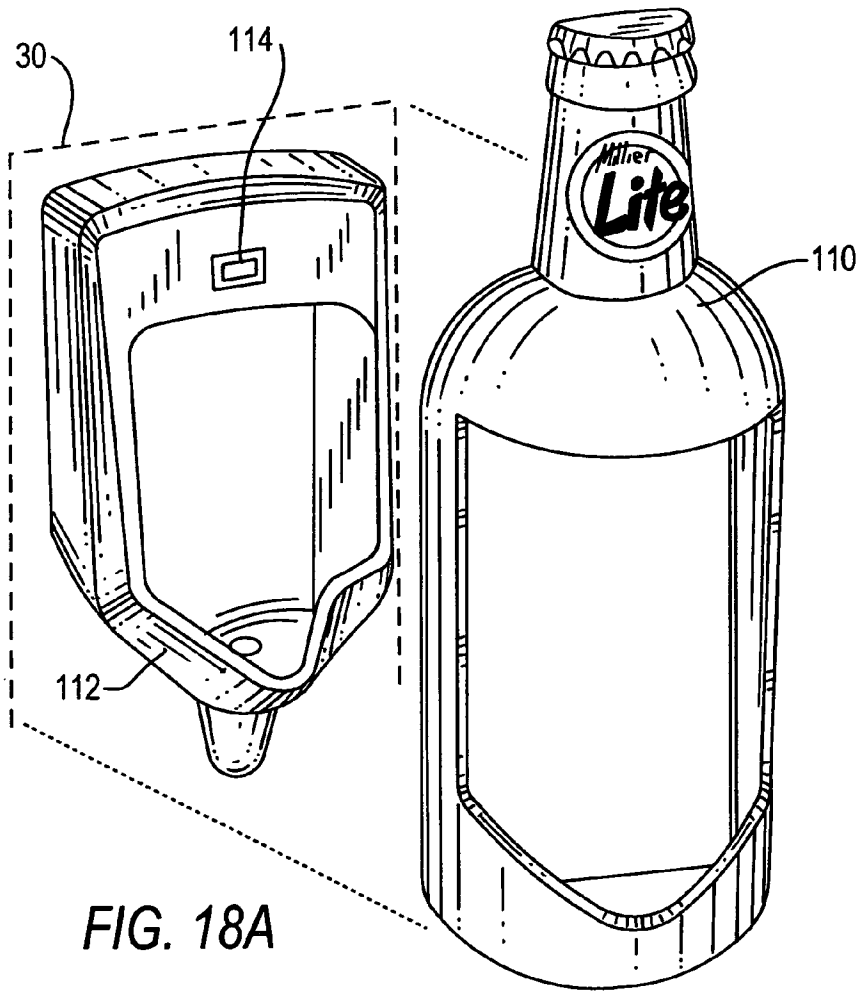
FIG. 18A is a perspective view showing the installation of a bottle-shaped advertisement article of yet another alternate embodiment over a urinal.

FIGS. 18A and 18B shown an alternate embodiment of a bottle-shaped advertisement articles 110 designed for use with a urinal 112 having a sensor 114 which causes the urinal 110 to be flushed when the sensor 114 detects that a user has stepped away from the front thereof. Advertisement articles 110 may be installed on wall adapter fixture 30, shown schematically in FIG. 18A, ultimately appearing as shown in FIG. 18B.

Figure 19:
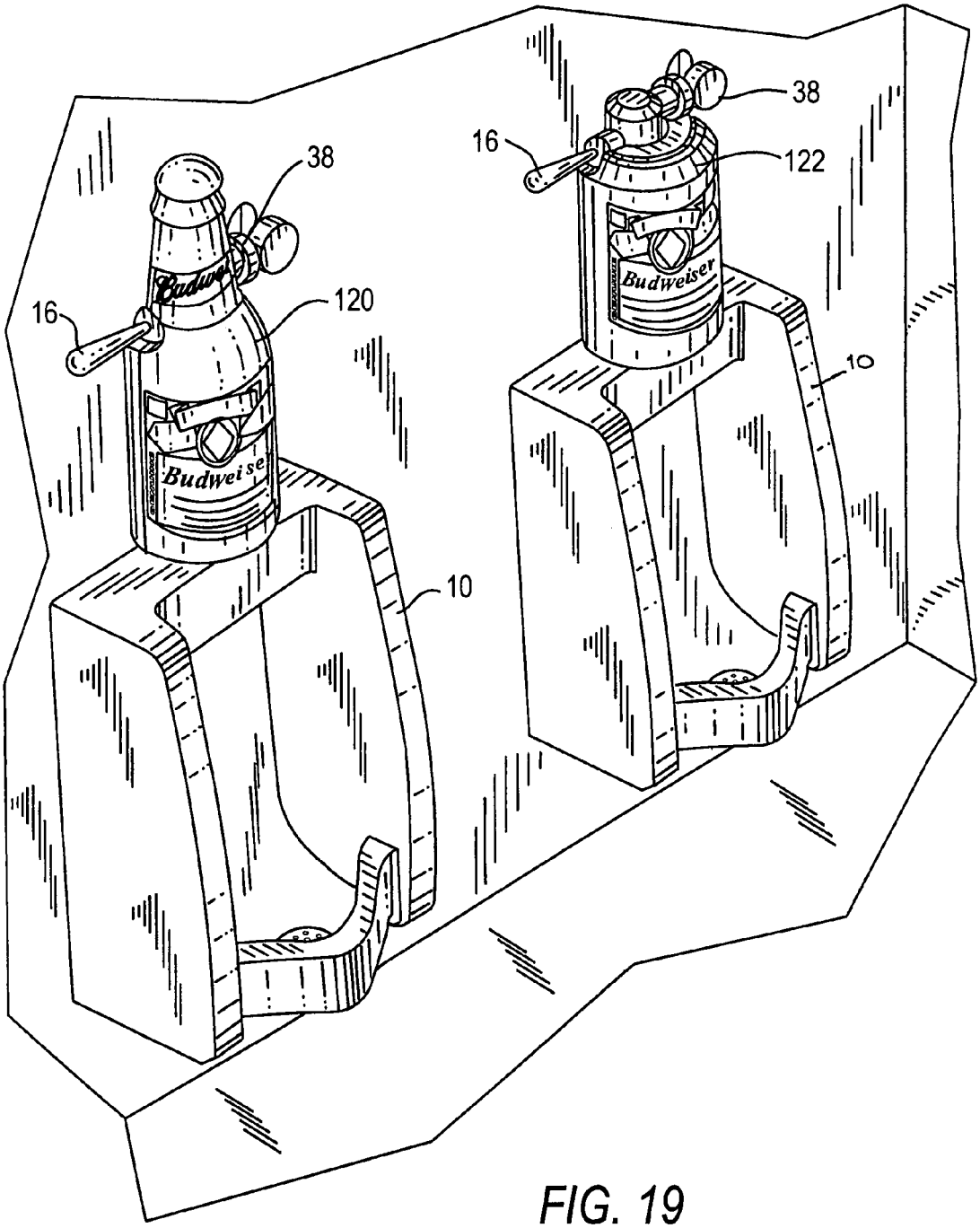
FIG. 19 is a perspective view of a pair of urinals having alternative advertisement articles installed over their flush valves.

FIG. 19 shows yet another embodiment of the advertisement articles of the present invention. The plumbing connection 38 for each urinal 10 is concealed by a bottle-shaped advertisement articles 120 on the left and by a can-shaped advertisement article 122 on the right. In each case, the handle 16 extends outward from an appropriate cut-out in the advertisement article 120, 122 so that the urinal 10 may be operated. This particular embodiment is intended for use where space is limited or in low-key applications, and is attached to the wall above the urinal 10 and around its plumbing connections 38, for example, by an adhesive.

Figure 20B:
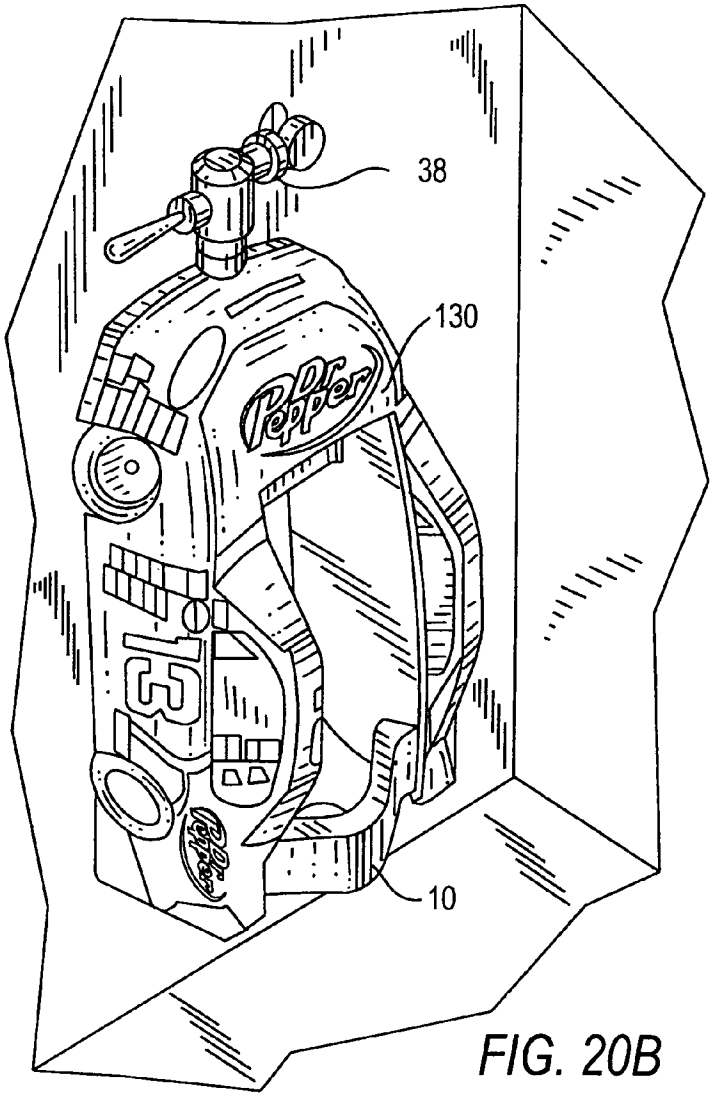
FIG. 20B is a perspective view showing the automobile-shaped advertisement article of FIG. 20A following installation over a urinal.
Figure 20A:
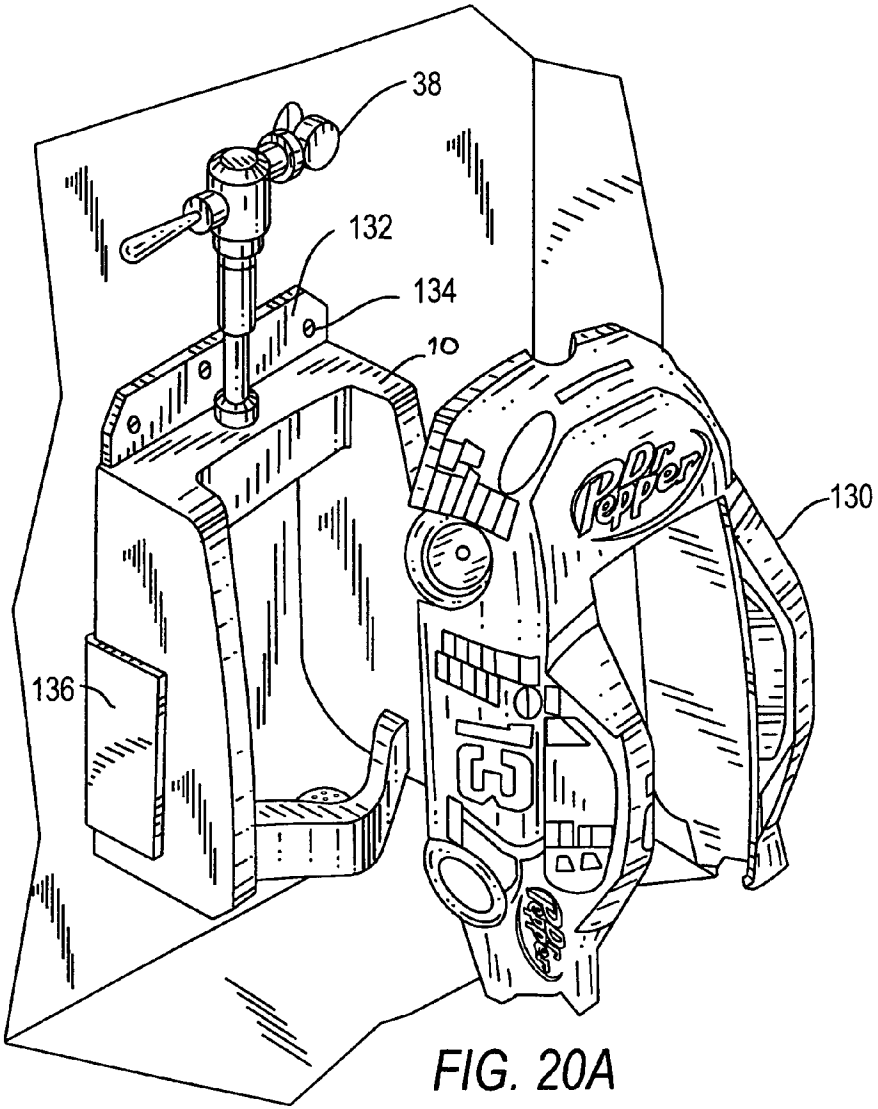
FIG. 20A is a perspective view showing the installation of an automobile-shaped advertisement article of still another alternate embodiment over a urinal.

The present invention may find application in the advertisement of products or services other than simply to beverages, such as beer and soft drinks. Referring to FIGS. 20A and 20B, an automobile-shaped advertisement article 130 is primarily intended to advertise NASCAR® auto racing. Secondarily, it may also advertise the products or services whose logos appear on the automobile-shaped advertisement article 130, as they may on actual NASCAR® autos to denote sponsorship. For present purposes, it may be necessary to invert or otherwise reorient the logos relative to their positions on actual NASCAR® autos, so that they may be in positions and orientations more clearly legible on the advertisement article 130.

In FIG. 20A, urinal 10 and plumbing connection 38 appear as previously shown. Wall adapter fixture 132 is mounted above urinal 10 using screws 134 or the like, and may include a plurality of hooks as previously shown. Adhesive plates 136 are provided on each side of the urinal 10 to prevent advertisement article 130 from slipping following installation as shown in FIG. 20B.

Figures 21A, 21B:
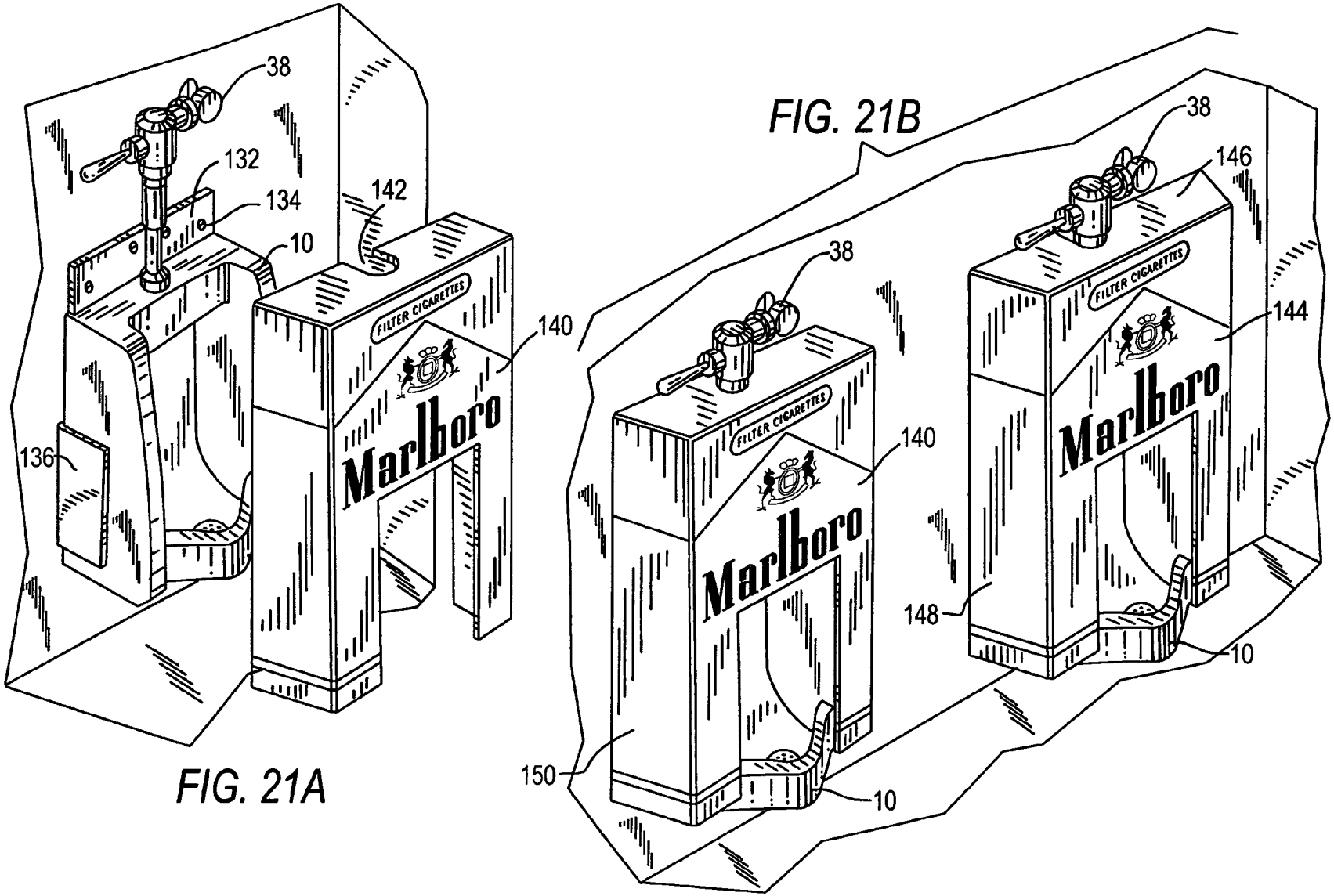
FIG. 21A is a perspective view showing the installation of a cigarette-box-shaped advertisement article of a further alternate embodiment over a urinal.
FIG. 21B is a perspective view showing two cigarette-box-shaped advertisement articles following installation over two adjacent urinals.

Similarly, referring to FIGS. 21A and 21B, a cigarette-box-shaped advertisement article 140, or a box-shaped advertisement article for any other product or service, may be installed on urinal 10 in the same manner as automobile-shaped advertisement article 130. Advertisement article 140 has a cut-out 142 on its top surface, so that it may fit around plumbing connection 38. FIG. 21B illustrates the appearance of cigarette-box-shaped advertisement article 140 following installation. It will be noted in FIG. 21B that cigarette-box-shaped advertisement article 144 on the right side has a top side 146 and left and right sides 148, which are tapered downwardly or inwardly, respectively, to give advertisement article 144 a sleeker appearance than advertisement article 140. The Surgeon General's warning 150 may be included on the side of the advertisement articles 140, 144, as it is on actual cigarette packs and boxes.

Figure 22:
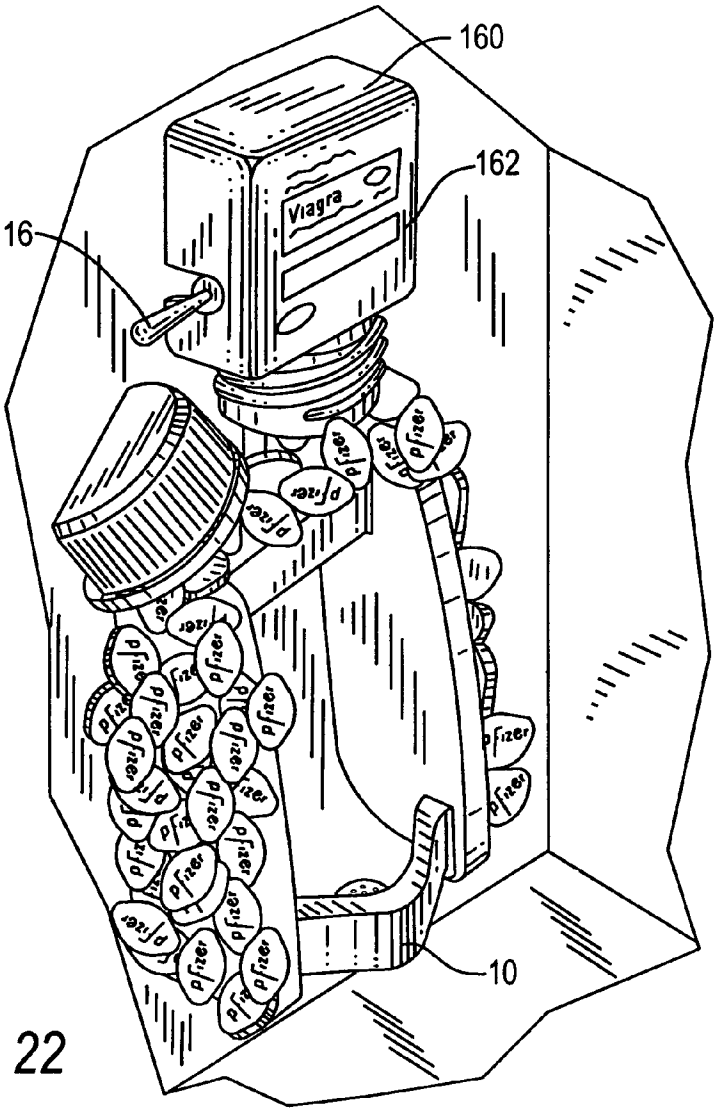

FIGS. 22 through 26 are perspective views of five different approaches for advertising a well-known medication. Referring to FIG. 22, advertisement article 160 is in the form of an inverted medication bottle whose contents and cap cover the top and sides of urinal 10. As was the case with previously described embodiments handle 16 protrudes from the side of the medication bottle, which has a label 162 inverted relative to its position on an actual bottle, so that it may be in an orientation more clearly legible on the advertisement article 160. Like advertisement articles 130, 140, advertisement article 160 may be mounted using wall adapter fixture 132, with adhesive plates 136 being provided on each side of the urinal 10 to prevent advertisement article 160 from slipping following installation.

Figure 23:
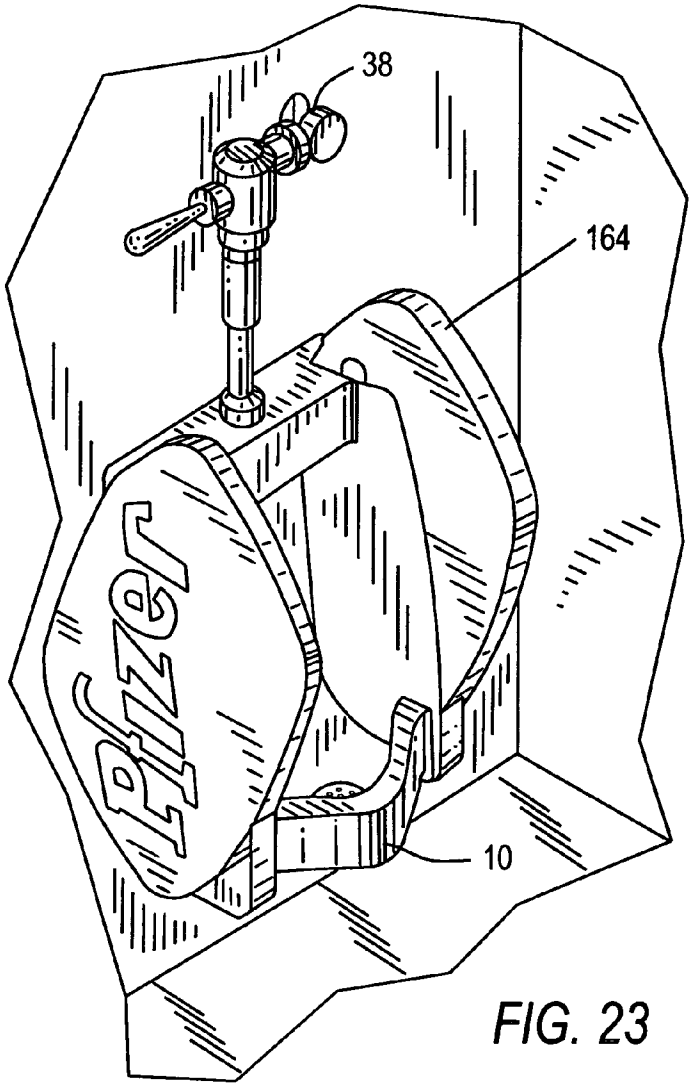
FIGS. 22 through 26 are perspective views of five alternate approaches for advertising a medication following installation over a urinal.

Adhesive plates 136 may also be used to mount pill-shaped advertisement articles 164 on the sides of urinal 10 in FIG. 23. Similarly, an advertisement article 170, molded to have the appearance of three pills or doses of the well-known medication. As before, the top portion of the advertisement article 170 may be mounted using wall-adapter fixture 132, with adhesive plates 136 being provided on each side of the urinal 10 to secure the side portions and to prevent advertisement article 170 from slipping following installation.

Figure 25:
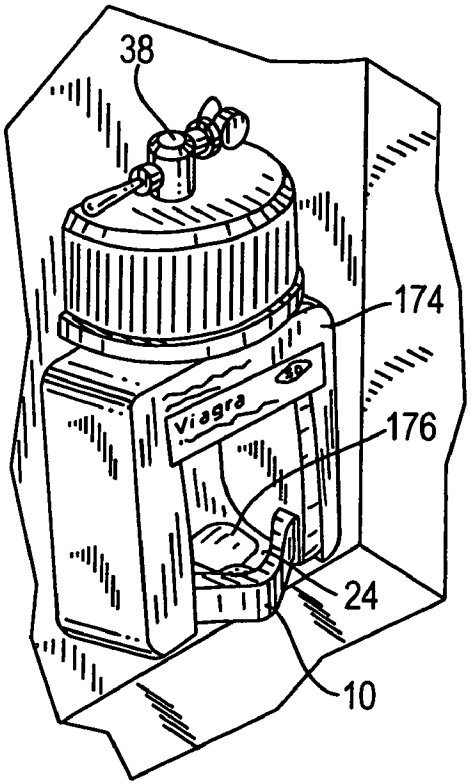
Figure 24:
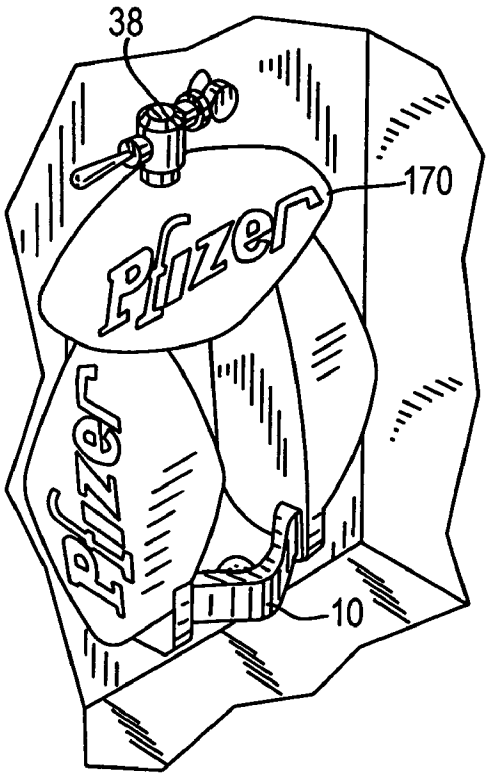

Referring now to FIG. 25, advertisement article 174 is akin to the bottle- and can-shaped advertisement articles previously shown, and can be mounted on or over urinal 10 in the previously described manner. Note that advertisement article 174 lends itself to the use of a pill-shaped freshener 176, having the color of the medication being advertised, in the reservoir 24 at the bottom of the urinal 10 to complement the bottle-shaped advertisement article 174.

Figure 26:
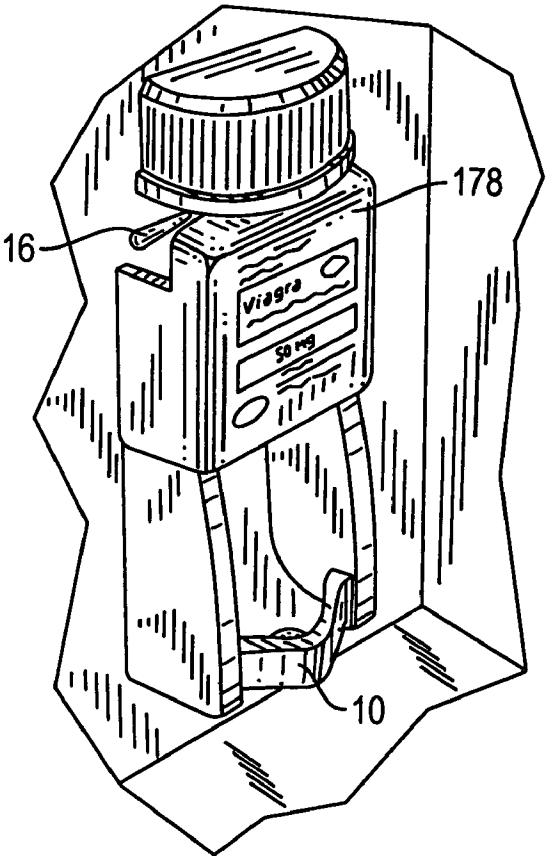

In FIG. 26, advertisement article 178 fits on top of urinal 10 and covers plumbing connection 38 except for handle 16. Advertisement article 178 is mounted on the wall above the urinal 10 like bottle-shaped advertisement article 120 and can-shaped advertisement article 132 shown in FIG. 19.

Figure 27:
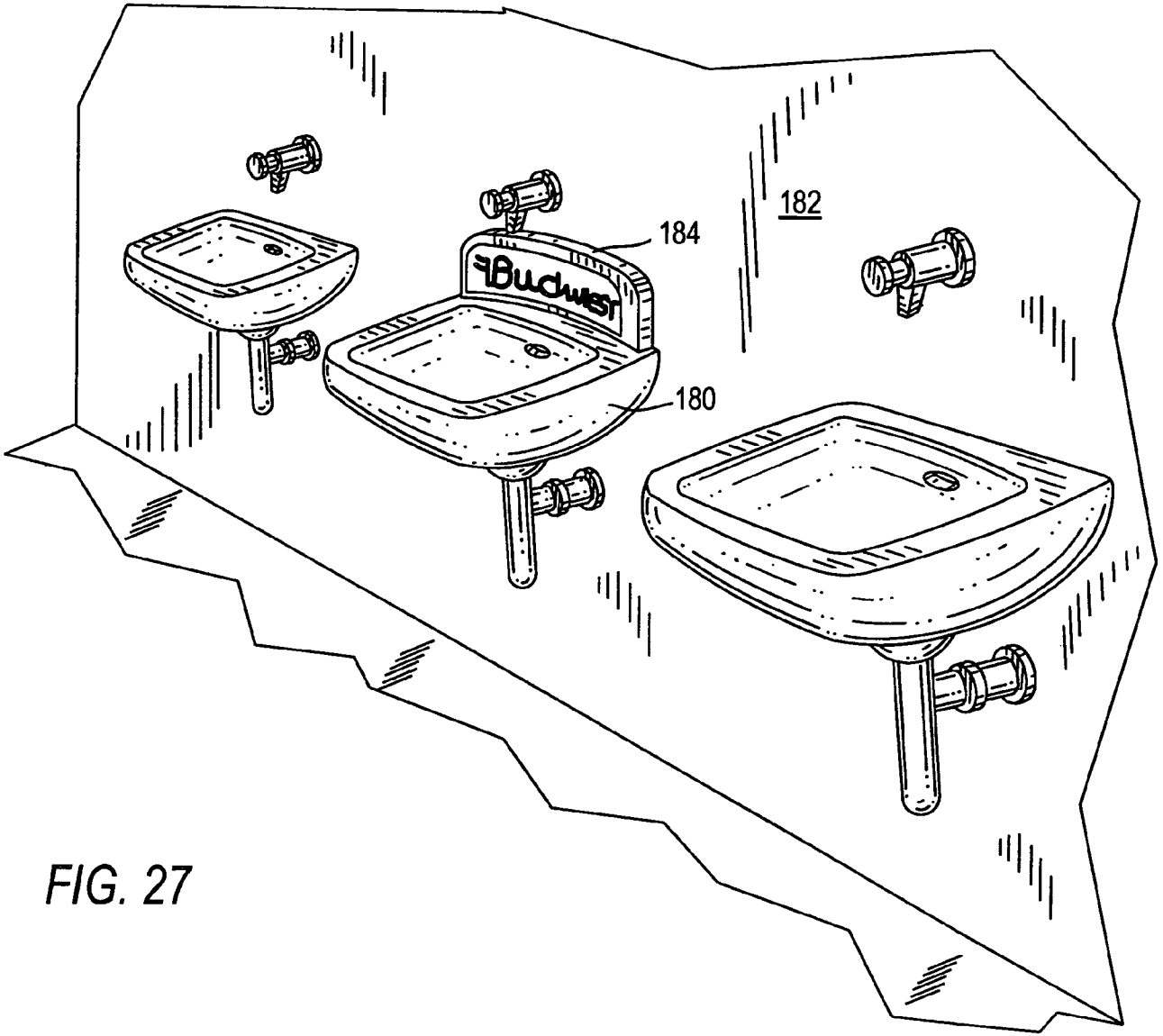
FIG. 27 is a perspective view of a row of sinks, one of which has an advertisement article installed on the wall over the top surface thereof.

Finally, referring to FIG. 27, the practice of the present invention may be extended to sinks, such as sink 180 of the type commonly found in a public restroom. On top of the sink 180 and against the wall 182 on which it is mounted, advertisement article 184 may be secured to promote any of a wide variety of products or services. Advertisement article 184 may be of any shape, and is not limited to the essentially rectangular form shown in FIG. 27.

While the messages being conveyed by the advertisement articles shown in the figures relate to a number of well-known products, the present invention should not be considered to be limited to the advertisement of the products shown. In fact, the bottle-shaped advertisement articles may be used to advertise anything that comes in a bottle, such as juices, energy drinks or soft drinks, and may be used to advertise materials that are not beverages. Moreover, the can-shaped advertisement articles may be used to advertise any beverage which is sold in a can, as well as, with a slight modification, may be used to advertise a product sold in a cup, such as coffee or tea, or other non-beverage products. The box-shaped advertisement articles and product-shaped advertisement articles may be used to advertise an innumerable variety of other products or services. In fact, the advertisement articles may take on any shape, particularly where the product or service being advertised does not have a particular shape associated with or suggestive of it.

Needless to say, the various advertisement articles shown in the various figures will have to be designed to stand up not only to the ordinary wear and tear that would be expected in a restroom, but also to vandalism and other destructive tendencies which often find an outlet in restrooms in public places. As such, the various advertisement articles may be molded from sturdy and resilient polymeric resin materials in three-dimensional form, and the advertisements applied to their surfaces according to methods well known in the art.

Modifications to the above would be obvious to those of ordinary skill in the art, but would not bring the invention so modified beyond the scope of the appended claims.

What is claimed is:

1. A method of advertising comprising the steps of:

a) providing a urinal, said urinal being mounted on a wall and having a top, a left side, a right side, a bottom, and an inner surface bounded by said top, left said, right side and bottom;

b) providing a three-dimensional advertisement article, said advertisement article being adapted for attachment to said wall and being adapted to cover at least said top of said urinal;

c) placing advertisement graphics on said three-dimensional advertisement article; and d) attaching said three-dimensional advertisement article to said wall to cover at least said top of said urinal, wherein said three-dimensional advertisement article is bottle-shaped and extends along said left side and said right side of said urinal.

2. A method as claimed in claim 1 wherein a plumbing connection extends upwardly from said top of said urinal and wherein said bottle-shaped advertisement article includes a neck at least partially covering said plumbing connection.

3. A method as claimed in claim 1 wherein said bottle-shaped advertisement article has a substantially concave central portion extending inwardly toward said inner surface of said urinal.

4. A method as claimed in claim 3 wherein said substantially concave central portion comprises a removable liner.

5. A method as claimed in claim 1 wherein said bottle-shaped advertisement article has a modular construction comprising a neck, a left side panel, a right side panel and a removable inner liner.

6. A method as claimed in claim 1 wherein said advertisement graphics relate to a beverage sold in a bottle.

7. A method as claimed in claim 1 wherein said advertisement graphics relate to a medication sold in a bottle.

8. A method as claimed in claim 1 wherein said bottle-shaped advertisement article extends along said left side and said right side and across said bottom of said urinal.

9. A method of advertising comprising the steps of:

a) providing a urinal, said urinal being mounted on a wall and having a top, a left side, a right side, a bottom, and an inner surface bounded by said top, left said, right side and bottom;

b) providing a three-dimensional advertisement article, said advertisement article being adapted for attachment to said wall and being adapted to cover at least said top of said urinal;

c) placing advertisement graphics on said three-dimensional advertisement article; and d) attaching said three-dimensional advertisement article to said wall to cover at least said top of said urinal, wherein said advertisement article is can-shaped and extends along said left side and said right side of said urinal.

10. A method as claimed in claim 9 wherein a plumbing connection extends upwardly from said top of said urinal and wherein said can-shaped advertisement article has a cut-out portion for said plumbing connection.

11. A method as claimed in claim 9 wherein said can-shaped advertisement article has a substantially concave central portion extending inwardly toward said inner surface of said urinal.

12. A method as claimed in claim 11 wherein said substantially concave central portion comprises a removable liner.

13. A method as claimed in claim 9 wherein said advertisement graphics relate to a beverage sold in a can.

14. A method as claimed in claim 9 wherein said can-shaped advertisement article extends along said left side and said right and across said bottom of said urinal.

15. A method of advertising comprising the steps of:

a) providing a urinal, said urinal being mounted on a wall and having a top, a left side, a right side, a bottom, and an inner surface bounded by said top, left said, right side and bottom;

b) providing a three-dimensional advertisement article, said advertisement article being adapted for attachment to said wall and being adapted to cover at least said top of said urinal;

c) placing advertisement graphics on said three-dimensional advertisement article; and d) attaching said three-dimensional advertisement article to said wall to cover at least said top of said urinal, wherein said advertisement article is box-shaped and extends along said left side and said right side of said urinal.

16. A method as claimed in claim 15 wherein said advertisement graphics relate to a product sold in a box.

17. A method as claimed in claim 15 wherein a plumbing connection extends upwardly from said top said urinal and wherein said box-shaped advertisement article has a cut-out portion for said plumbing connection.

18. A method as claimed in claim 15 wherein said advertisement graphics relate to a service.

19. A method as claimed in claim 15 wherein said box-shaped advertisement article has a tapered top and tapered sides.

* * * * *